US009771763B2

(12) United States Patent
McDaniel et al.

(10) Patent No.: US 9,771,763 B2
(45) Date of Patent: Sep. 26, 2017

(54) LOW-CLEARANCE CENTRALIZER

(71) Applicant: Antelope Oil Tool & Manufacturing Co., LLC, Minerals Wells, TX (US)

(72) Inventors: Troy McDaniel, Weatherford, TX (US); Jean Buytaert, Mineral Wells, TX (US); Eugene Edward Miller, Weatherford, TX (US)

(73) Assignee: ANTELOPE OIL TOOL & MFG. CO., Houston, TX (US)

( * ) Notice: Subject to any disclaimer, the term of this patent is extended or adjusted under 35 U.S.C. 154(b) by 565 days.

(21) Appl. No.: 14/196,974

(22) Filed: Mar. 4, 2014

(65) Prior Publication Data

US 2014/0182839 A1 Jul. 3, 2014

Related U.S. Application Data

(60) Continuation-in-part of application No. 12/913,495, filed on Oct. 27, 2010, now Pat. No. 8,662,166, which is a division of application No. 11/749,544, filed on May 16, 2007, now Pat. No. 7,845,061.

(51) Int. Cl.
*E21B 17/10* (2006.01)

(52) U.S. Cl.
CPC ..... *E21B 17/1028* (2013.01); *E21B 17/1064* (2013.01); *E21B 17/1078* (2013.01)

(58) Field of Classification Search
CPC ..... E21B 17/1028; E21B 17/1064; E21B 17/17078
See application file for complete search history.

(56) References Cited

U.S. PATENT DOCUMENTS

| | | | |
|---|---|---|---|
| 1,201,706 | A | 10/1916 | Dodge |
| 1,905,103 | A | 4/1933 | Johnson |
| 2,009,496 | A | 7/1935 | Johnson |
| 2,312,600 | A | 3/1943 | Steps |

(Continued)

FOREIGN PATENT DOCUMENTS

| | | |
|---|---|---|
| DE | 4024000 | 1/1992 |
| EP | 0088507 A1 | 9/1983 |

(Continued)

OTHER PUBLICATIONS

Unknown Author, Frank's Anaconda Stop Collar Sheet, Frank's Casing Crew & Rental Tools, Inc., Lafayetter, LA, 2003, 1 page.

(Continued)

*Primary Examiner* — Sarang Afzali
(74) *Attorney, Agent, or Firm* — MH2 Technology Law Group, LLP

(57) ABSTRACT

A centralizer assembly includes a centralizer configured to centralize a tubular in a wellbore. The centralizer includes a first end collar, a second end collar, and ribs extending between the first and second end collars. The assembly also includes a first stop collar disposed adjacent the first end collar and including an anchor. The anchor defines a generally rectangular anchor window extending therethrough. The anchor is configured to bear on an anchoring material secured to the tubular and received through the anchor window. The anchor material includes a thermal spray applied to the tubular. The first end collar is prevented from rotation with respect to the first stop collar.

13 Claims, 14 Drawing Sheets

(56) References Cited

U.S. PATENT DOCUMENTS

| | | | | |
|---|---|---|---|---|
| 2,368,401 | A | | 1/1945 | Baker |
| 2,496,402 | A | | 2/1950 | McVeigh et al. |
| 2,546,582 | A | | 3/1951 | Baker |
| 2,718,266 | A | | 9/1955 | Berry et al. |
| 2,797,756 | A | | 7/1957 | Hall, Sr. |
| 2,824,613 | A | | 2/1958 | Baker et al. |
| 2,855,052 | A | | 10/1958 | Wright et al. |
| 2,962,313 | A | | 11/1960 | Conrad |
| 2,986,417 | A | | 5/1961 | Baker |
| 2,998,848 | A | | 9/1961 | Wright et al. |
| 3,040,405 | A | | 6/1962 | Solum |
| 3,055,432 | A | | 9/1962 | Park |
| 3,063,760 | A | | 11/1962 | Gifford |
| 3,124,196 | A | | 3/1965 | Solum |
| 3,200,884 | A | | 8/1965 | Solum et al. |
| 3,292,708 | A | | 12/1966 | Mundt |
| 3,356,147 | A | | 12/1967 | Dreyfuss |
| 3,360,846 | A | | 1/1968 | Schellstede et al. |
| 3,563,575 | A | | 2/1971 | Sanford |
| 3,566,965 | A | | 3/1971 | Solum |
| 3,652,138 | A | | 3/1972 | Collett |
| 3,729,797 | A | | 5/1973 | Ambrose |
| 3,913,390 | A | * | 10/1975 | Piazza ..... A61B 3/16 385/116 |
| 3,916,998 | A | | 11/1975 | Bass, Jr. et al. |
| 4,021,083 | A | | 5/1977 | Anderson |
| 4,146,060 | A | | 3/1979 | Garrett |
| 4,189,817 | A | | 2/1980 | Moebius |
| 4,269,269 | A | | 5/1981 | Wilson |
| 4,328,839 | A | | 5/1982 | Lyons et al. |
| 4,363,360 | A | | 12/1982 | Richey |
| 4,367,053 | A | | 1/1983 | Stratienko et al. |
| 4,434,125 | A | | 2/1984 | Lavender et al. |
| 4,531,582 | A | | 7/1985 | Muse et al. |
| 4,545,436 | A | | 10/1985 | Harrison |
| 4,641,776 | A | | 2/1987 | Vlasek et al. |
| 4,651,823 | A | | 3/1987 | Spikes |
| 4,688,636 | A | | 8/1987 | Hennessey |
| 4,787,458 | A | | 11/1988 | Langer |
| 4,909,322 | A | | 3/1990 | Patterson et al. |
| 5,238,062 | A | | 8/1993 | Reinholdt |
| 5,253,407 | A | | 10/1993 | Jamrus |
| 5,261,488 | A | | 11/1993 | Gullet et al. |
| 5,501,281 | A | | 3/1996 | White et al. |
| 5,517,878 | A | | 5/1996 | Klein et al. |
| 5,575,333 | A | | 11/1996 | Lirette et al. |
| 5,706,894 | A | | 1/1998 | Hawkins, III |
| 5,743,302 | A | | 4/1998 | McNeely |
| 5,817,952 | A | | 10/1998 | Swisher et al. |
| 5,860,760 | A | | 1/1999 | Kirk |
| 5,908,072 | A | | 6/1999 | Hawkins |
| 6,209,638 | B1 | | 4/2001 | Mikolajczyk |
| 6,361,253 | B1 | | 3/2002 | Geib |
| 6,457,519 | B1 | | 10/2002 | Buytaert et al. |
| 6,484,803 | B1 | | 11/2002 | Gremillion |
| 6,679,325 | B2 | | 1/2004 | Buytaert |
| 6,679,335 | B2 | | 1/2004 | Slack et al. |
| 6,725,939 | B2 | | 4/2004 | Richard |
| 6,871,706 | B2 | | 3/2005 | Hennessey |
| 6,957,704 | B2 | | 10/2005 | Rogers et al. |
| 6,997,254 | B2 | | 2/2006 | Jenner |
| 7,096,939 | B2 | | 8/2006 | Kirk et al. |
| 7,143,848 | B2 | | 12/2006 | Armell |
| 7,159,619 | B2 | | 1/2007 | Latiolais, Jr. et al. |
| 7,188,687 | B2 | | 3/2007 | Rudd et al. |
| 7,377,325 | B2 | | 5/2008 | Trinder et al. |
| 7,845,061 | B2 | | 12/2010 | Buytaert et al. |
| 7,878,241 | B2 | | 2/2011 | Buytaert et al. |
| 8,196,654 | B2 | | 6/2012 | Buytaert et al. |
| 8,196,670 | B2 | | 6/2012 | Jenner |
| 8,266,774 | B1 | | 9/2012 | Doty |
| 8,662,166 | B2 | | 3/2014 | Buytaert et al. |
| 2002/0139537 | A1 | | 10/2002 | Mack et al. |
| 2002/0139538 | A1 | | 10/2002 | Mack et al. |
| 2003/0000607 | A1 | | 1/2003 | Jenner |
| 2003/0019637 | A1 | | 1/2003 | Slack et al. |
| 2004/0173349 | A1 | | 9/2004 | Pointing |
| 2005/0183864 | A1 | | 8/2005 | Trinder et al. |
| 2008/0035331 | A1 | | 2/2008 | Buytaert |
| 2008/0115972 | A1 | | 5/2008 | Lynde et al. |
| 2008/0156488 | A1 | | 7/2008 | Thornton |
| 2008/0283253 | A1 | | 11/2008 | Buytaert et al. |
| 2009/0025929 | A1 | | 1/2009 | Buytaert et al. |
| 2009/0255666 | A1 | | 10/2009 | Olsen et al. |
| 2010/0218956 | A1 | | 9/2010 | Buytaert |
| 2010/0326671 | A1 | | 12/2010 | Buytaert |
| 2012/0151727 | A1 | | 6/2012 | Dewell |

FOREIGN PATENT DOCUMENTS

| | | | |
|---|---|---|---|
| GB | 2148985 | | 6/1985 |
| GB | 2304753 | A | 3/1997 |
| GB | 2403238 | A | 12/2004 |
| WO | 9108374 | | 6/1991 |
| WO | 9964714 | A | 12/1999 |
| WO | 2005107395 | | 11/2005 |
| WO | 2007/143324 | A1 | 12/2007 |

OTHER PUBLICATIONS

Buytaert et al., "Downhole Device Actuator and Method", U.S. Appl. No. 12/569,811, filed Sep. 29, 2009.

Buytaert et al., "Apparatus for and Method of Deploying a Centralizer Installed on an Expandable Casing String", U.S. Appl. No. 11/828,943, filed Jul. 26, 2007.

PCT International Search Report and Written Opinion dated Sep. 9, 2008, PCT Application No. PCT/US2008/063097, filed May 8, 2008, pp. 1-14.

PCT International Search Report and Written Opinion dated Nov. 28, 2008, PCT Application No. PCT/US2008/063163, filed May 9, 2008, 19 pages.

PCT International Search Report and Written Opinion dated Sep. 29, 2008, PCT Application No. PCT/US2008/068891, filed Jul. 1, 2008, 11 pages.

Author Unknown, Focus on New Technology, Fall 2007, 1 page.

Buytaert et al., "Low Clearance Centralizer and Method of Making Centralizer", U.S. Appl. No. 11/749,544, filed May 16, 2007.

Non-Final Office Action dated Mar. 31, 2010, U.S. Appl. No. 12/042,989, filed Mar. 5, 2008, pp. 1-6.

Non-Final Office Action dated Mar. 6, 2013, U.S. Appl. No. 13/476,807, filed May 21, 2012, pp. 1-7.

Non-Final Office Action dated Sep. 13, 2012, U.S. Appl. No. 12/756,177, filed Apr. 8, 2010, pp. 1-9.

Final Office Action dated Feb. 1, 2013, U.S. Appl. No. 12/756,177, filed Apr. 8, 2010, pp. 1-12.

Final Office Action dated Mar. 13, 2014, U.S. Appl. No. 12/756,177, filed Apr. 8, 2010, pp. 1-11.

Non-Final Office Action dated Aug. 27, 2015, U.S. Appl. No. 14/046,320, filed Oct. 4, 2013, pp. 1-8.

International Search Report dated Dec. 23, 2010, PCT Application No. PCT/US2010/037441, filed Jun. 4, 2010, pp. 1-5.

Non-Final Office Action dated Oct. 18, 2013, U.S. Appl. No. 12/756,173, filed Apr. 7, 2010, pp. 1-14.

Canadian Office Action dated Feb. 29, 2016, Canadian Application No. 2,757,459, filed Jun. 4, 2010, pp. 1-6.

* cited by examiner

LOW-CLEARANCE CENTRALIZER

CROSS-REFERENCE TO RELATED APPLICATIONS

This application is a continuation-in-part of U.S. patent application having Ser. No. 12/913,495, which is a divisional application of U.S. patent application having Ser. No. 11/749,544, now U.S. Pat. No. 7,845,061. The entirety of both of these priority applications is incorporated herein by reference.

BACKGROUND

Centralizers are commonly secured at spaced intervals along a casing or tubing string to provide radial stand-off of the casing or tubing from the interior wall of a borehole in which the string is subsequently installed. The centralizers generally comprise generally aligned collars defining a bore there through for receiving the casing, and a plurality of angularly-spaced ribs that project radially outwardly from the casing string to provide the desired stand-off from the interior wall of the borehole. Centralizers ideally center the casing within the borehole to provide a generally uniform annulus between the casing string exterior and the interior wall of the borehole. This centering of the casing string within the borehole promotes uniform and continuous distribution of cement slurry around the casing string during the subsequent step of cementing the casing string within an interval of the borehole. Uniform cement slurry distribution results in a cement liner that reinforces the casing string, isolates the casing from corrosive formation fluids, and prevents unwanted fluid flow between penetrated geologic formations.

A bow-spring centralizer is a common type of centralizer that employs flexible bow-springs as the ribs. Bow-spring centralizers typically include a pair of axially-spaced and generally aligned collars that are coupled one to the other by a plurality of bow-springs. The flexible bow-springs are predisposed to deploy and bow radially outwardly away from the axis of the centralizer to engage the interior wall of the borehole and to center a casing received axially through the generally aligned bores of the collars. Configured in this manner, the bow-springs provide stand-off from the interior wall of the borehole, and may flex or collapse radially inwardly as the centralizer encounters borehole obstructions or interior wall of the borehole protrusions into the borehole as the casing string is installed into the borehole. Elasticity allows the bow-springs to spring back to substantially their original shape after collapsing to pass a borehole obstruction, and to thereby maintain the desired stand-off between the casing string and the interior wall of the borehole.

Some centralizers include collars that move along the length of the casing in response to flexure of the bow springs. For example, U.S. Pat. No. 6,679,325 discloses, in part, a low-clearance centralizer having an extendable collar at each end, each extendable collar comprising a moving collar and a stop collar that cooperate to form an extendable collar. The extendable collar at each end of the centralizer of the '325 patent includes a longitudinal bore within the aligned extendable collars for receiving the casing to which the stop collars are secured to position the centralizer on the casing. Each moving collar has a collet with a radially outwardly flanged portion for being movably received within an interior circumferential groove or bore within the mating stop collar. A plurality of flexible bow springs are secured at each end to a moving collar, and the two moving collars are maintained in a variable spaced-apart relationship by the bow springs and the stop collars.

A shortcoming of the centralizer of the '325 patent is that the stop collar and the moving collar require axially overlapping structures in order to slidably interface one with the other. This overlapping structure adds to the radial thickness of a centralizer of comparable strength, thereby increasing the minimum collapsed diameter of the casing centralizer and limiting the borehole restrictions through which the centralizer and a casing can pass.

The radial thickness added to the exterior of a casing string by an installed centralizer is but one factor to be considered in selecting a centralizer for a given application. The cost of manufacturing the centralizer is also an important consideration. Many movable collars require the manufacture of complicated mechanisms as compared with simple stationary collars. Even less complicated designs include moving collars that are assembled using multiple components, each of which must be separately manufactured and subsequently assembled into a moving collar. While the end result is useful, the costs of manufacturing multiple components, and the costs associated with assembling the components into a centralizer, make these devices relatively expensive. Thus, there is an ongoing need for centralizers having extendable collars that are radially thinner, but less expensive to manufacture and assemble.

SUMMARY

The present disclosure provides a low-clearance and efficiently manufactured centralizer for use in centering a casing within an earthen borehole. The low-clearance centralizer comprises a stop collar having a bore, the stop collar securable to the exterior of a casing in a spaced-apart relationship to an opposing stop collar having a generally aligned bore, the opposing stop collar also securable to the exterior of the casing. Each stop collar is movably interlocked with and cooperates with a moving collar that is formed along with the stop collar from a single tube. Each moving collar is secured to its stop collar using a circumferentially interlocking structure to form an extendable collar. The moving end of the extendable collar receives and secures to the ends of a plurality of bow-springs that may also be formed from the same single tube from which the extendable collar is formed.

The bow springs of the centralizer of the present disclosure are modified—after being cut from the tube—to bow radially outwardly and thereby deploy against a interior wall of the borehole to provide stand-off between the casing and the interior wall of the borehole. The bow springs are sufficiently flexible to elastically collapse from the deployed condition to a collapsed condition to lie generally along the length of the exterior wall of the casing received within the centralizer. A portion of the arc length of the bow springs in their deployed (or bowed) condition is receivable within the retracted length of one of the extendable collars. The centralizer of the present invention is adapted for being pulled through a tight restriction in the borehole by the leading extendable collar. The extendable collars may be designated as a leading collar and a trailing collar, depending on the direction of movement of the casing string and the centralizer affixed thereon. As the deployed bow springs encounter the borehole restriction, the leading extendable collar is extended to its greatest length upon being introduced into the borehole restriction; that is, the leading moving collar, and the bow springs secured at a leading end to the leading moving collar, slide—according to the collapsing force imparted to the bow springs by the borehole restriction—to an extreme configuration for separation of the leading stop collar from the leading moving collar to fully extend the leading extendable collar. As the bow springs continue to collapse to lie generally flat along the exterior surface of the portion of the casing between the leading and trailing extendable collars, a portion of the arc length from previously bowed and deployed bow springs is generally straightened and received within the stroke of the trailing extendable collar as it retracts to a shorter length. Upon passage of the bow springs of the centralizer through the borehole restriction, the resiliency of the bow springs restore the bow springs to their radially outwardly deployed condition and both the leading and the trailing extendable collars are restored to their extended condition, unless the centralizer continues to be shaped by some outside force such as frictional contact between the deployed bow springs and the interior wall of the borehole.

The low-clearance centralizer of the present invention achieves its low-clearance design as a result of the inventive method of making the centralizer from a tube. A laser may be used to cut a tube into three interlocking pieces comprising two stop collars at the ends, and a center assembly, comprising two moving collars with a plurality of bow springs, intermediate the two moving collars. Alternately, a high pressure water nozzle may be used to create a water jet to cut the tube wall. The centralizer formed in this manner from a single tube in accordance with the present invention comprises two extendable collars, each extendable collar comprising one of the stop collars movably interlocked with the adjacent moving collar of the center assembly. The movement between a stop collar and the adjacent moving collar is provided by cutting the tube into an interlocking pattern and by strategically cutting and removing coupons from the interlocked wall of the tube to facilitate axial movement, but not rotation, between the stop collar and the adjacent moving collar. The cutting and removal method of the present invention results in protrusions extending from one of either the moving collar or the stop collar, or both, being slidably captured within a chamber cut into the other.

Further, embodiments of the disclosure may provide a collar. The collar includes a first portion, and a second portion coupled with the first portion such that the first and second portions are slidable one relative to the other along a longitudinal axis of the collar. The collar is axially expandable by sliding the first portion relative to the second portion. The collar also includes an anchor coupled with the second portion. The anchor defines one or more anchor windows extending therethrough and configured to expose a portion of a tubular when the tubular is received through the collar. The anchor is configured to bear on an anchoring material received radially inwards through the one or more anchor windows. The anchor does not force the anchoring material into engagement with the tubular when the tubular is received through the collar, the anchoring material being coupled with the tubular.

Embodiments of the disclosure may also provide a centralizer assembly. The centralizer assembly includes a bow-spring centralizer including a first end collar, a second end collar, and a plurality of flexible ribs extending between the first and second end collars. The centralizer assembly also includes a first stop collar disposed adjacent the first end collar. The first stop collar includes a first portion engaging the first end collar, and a second portion coupled with the first portion such that the first and second portions are slidable one relative to the other along a longitudinal axis of the first end collar. The first stop collar is axially expandable by sliding the first portion relative to the second portion. The first stop collar also includes an anchor coupled with the second portion. The anchor defines one or more anchor windows extending therethrough and is configured to expose a portion of a tubular when the tubular is received through the collar. Further, the anchor is configured to bear on a non-threaded anchoring material received radially inwards through the one or more anchor windows, with the anchoring material being coupled with the tubular.

Embodiments of the disclosure may further provide a stop collar. The stop collar includes a first portion including a first base and a plurality of first extensions extending axially therefrom along a longitudinal axis of the stop collar. The plurality of first extensions include a plurality of first heads, and the first portion defines a plurality of first chambers. The stop collar also includes a second portion including a second base and a plurality of second extensions extending axially therefrom along the longitudinal axis. The plurality of second extensions include a plurality of second heads that are received into the first chambers. The second portion defines a plurality of second chambers in which the first heads are disposed. The first portion and the second portion are slidable one relative to the other. The stop collar also includes an anchor coupled with the second portion. The anchor includes an anchor base that is offset from the second base along the longitudinal axis, and a plurality of anchor legs that extend along the longitudinal axis between the anchor base and the second base. The anchor defines one or more anchor windows extending radially therethrough and positioned between the second base, the anchor base, and the anchor legs, the one or more anchor windows being configured to receive an anchoring material radially inwards therethrough. The anchoring material includes a thermal spray metal, and wherein the anchor is configured to bear on the anchoring material so as to prevent movement of the stop collar relative to a casing.

DETAILED DESCRIPTION

Figure 1:
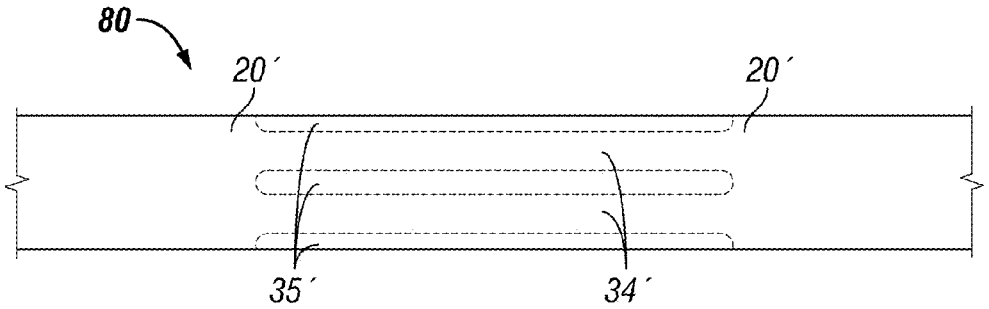
FIG. 1 is a side elevation view of tube having a superimposed pattern illustrating the cuts for making the central cage assembly of one embodiment of the centralizer of the present invention.

Embodiments of the present disclosure provide a centralizer and a method of forming a centralizer. The centralizer may include three or more members: a cage comprising a plurality of bow springs intermediate a first extendable collar and a second extendable collar. The centralizer of the present disclosure may, in some cases, be cut from a tube using a laser or some other device for precision cutting the wall of a tube.

In one embodiment of a method consistent with the present disclosure, the tube is cut, preferably using a laser, along a pre-programmed pattern to remove generally elongate material coupons to form an open-ended and generally tubular cage having a plurality of generally parallel ribs. The ribs may be equi-angularly distributed about the axis of the tube. At each end of the cage, and after the ribs of the cage are formed into bow springs, the remaining portions of the tube are cut to form a pair of opposed extendable collars, each comprising a stop collar and a moving collar. The stop collar and moving collar of each extendable collar are permanently interlocked one with the other unless one or both are deformed from their generally tubular shape to be separated.

The stop collar and the moving collar may, in at least one case, be formed, one adjacent to each end of the cage, by cutting the tube wall in a circumferentially interlocked configuration, and by strategic removal of material coupons from the wall of the tube. The stop collar and the moving collar formed thereby may be generally rotatably locked, in one embodiment, but axially movable, one relative to the other. The range of axial movement between the stop collar and the moving collar may be determined by the axial length of the removed material coupons and the configuration of the portions of the pattern that extend along the axis of the tube.

The interlocked configuration cut into the tubular wall in forming each extendable collar may vary in geometrical shape. Generally, the interlocked configuration may include two or more interlocked tubular members, a stop collar and a moving collar. Each interlocked tubular member of the extendable collar includes a plurality of circumferentially distributed heads, each head integrally formed on the end of an extension that extends axially from the member. Each head is captured within a circumferential chamber formed intermediate adjacent extensions from the opposite interlocked member. The axial extensions from the stop collar, which are shaped from the wall of the tube, are integrally formed with heads that are slidably captured within chambers that are cut into the wall of the tube from which the moving collar is formed. Also, the axial extensions from the moving collar, which are shaped from the wall of the tube, are integrally formed with heads that are slidably captured within chambers that are cut into the wall of the tube from which the stop collar is formed. The heads connected to the extensions may have a variety of shapes, such as generally rectangular, arrow-shaped or bulbous or teardrop-shaped, but all are generally curved with the radius of the wall of the tube from which the extendable collars/extension/heads are cut.

Each head may be integrally formed with a generally central axially-oriented extension intermediate the head and the body of the tubular member (i.e., the stop collar or the moving collar). Each head is axially movably captured within one of a plurality of chambers formed within the tubular member. Consecutive, angularly distributed extensions of the first tubular member define the side walls of a chamber in which a head of the opposing second tubular member is movably captured (the "captured head"), and vice-versa. The body of the first tubular member may provide an end wall of a chamber within the first tubular member for limiting movement of the captured head extending from the second tubular member in the axial direction. Each extension from a tubular member is slidably received within the space between adjacent heads of the other tubular member. The heads integrally formed on consecutive extensions of the first tubular member limit axial movement of the captured head extending from the second tubular member. The first and second tubular members are, thereby, rotatably locked on relative to the other, and axially movable one relative to the other between a retracted configuration corresponding to the shorter configuration of the extendable collar and an extended configuration corresponding to the extended configuration of the extendable collar.

In the extended configuration, each captured head of one tubular member abuts the heads on the interlocked tubular member that, in part, define a portion of the chamber. In the retracted configuration, the captured heads may, but do not necessarily, abut the end walls of the respective chamber (see discussion of allowance for debris accumulation below). Thus, the first and second tubular members are "slidably interlocked" within a defined range of axial movement between the extended and retracted configurations.

It will be appreciated that the foregoing description of one or more embodiments is illustrative of merely a subset of the embodiments contemplated herein, several examples of which will be described in greater detail below with reference to the drawings.

FIG. 1 is a side elevation view of tube 80 having a superimposed pattern illustrating the cuts for making a cage that may be formed into the bow springs of a centralizer of the present invention. While an actual pattern could be literally drawn on the exterior wall of the tube, in other cases, a cutting pattern may be programmed into a memory storage device having a computer for automated positioning and movement of a cutting device, such as a laser or a water jet, along a predetermined set of positions to cut the wall of the tube 80. For example, cutting of the tube according to the superimposed pattern may be effected by moving and positioning a laser beam of sufficient power to follow the pattern to cut a stationary tube 80, or by moving and positioning a tube 80 along a predetermined set of positions relative to a stationary laser beam, or by positioning both the laser and the tube simultaneously. The axially extending cage defined by the superimposed pattern on the tube 80 in FIG. 1 comprises elongate ribs 34' extending in an axial direction. As seen in FIG. 1, the cutting of the tube 80 along the pre-programmed pattern will result in the cutting of a plurality of material coupons 35' that may be removed from the tube wall to form the cage.

Figure 2:
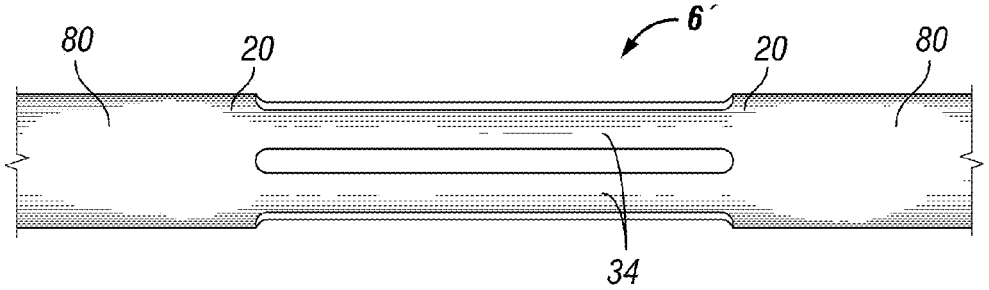
FIG. 2 is a side elevation view of a cage produced from the tube of FIG. 1 by cutting according to the superimposed pattern shown in FIG. 1 and to remove a plurality of elongate material coupons from the wall of the tube to form a cage intermediate two remaining uncut portions of the tube.

FIG. 2 is a side elevation view of an open-ended cage produced from the tube 80 of FIG. 1 by cutting according to the pre-programmed pattern and to remove a plurality of material coupons 35' from the wall of the tube 80 to form a cage comprising a plurality of ribs 34 intermediate two remaining portions of the tube 80. The cage may generally be formed by using a laser to cut three or more generally identical elongated and angularly distributed material coupons (see FIG. 1, elements 35') from the tube wall. The removal of the elongate coupons from the tube 80 leaves a plurality of three or more ribs 34 thereby forming a generally cylindrical cage from the tube 80.

Figure 3:
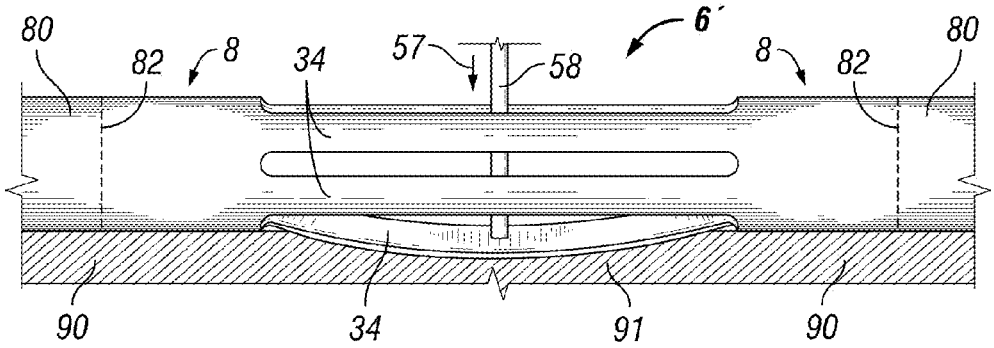
FIG. 3 is a side elevation view of the cage of FIG. 2 supported at each end by a support member, and a pushrod engaging and displacing a rib of the cage to form a bow spring.
Figure 4:
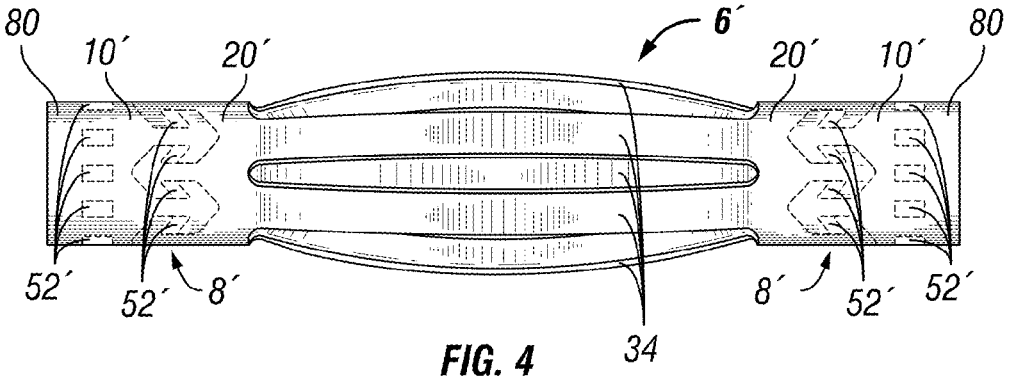
FIG. 4 is the elevation view of the cage with bow springs intermediate a pair of superimposed patterns illustrating cuts for making an extendable collar adjacent to each end of the bow springs.

FIG. 3 is an elevation view of the cage and tubular end portions 80 of FIG. 2 supported at each end portion by a support member 90 to support the cage while a pushrod 58 is used to displace a rib 34 from its original position shown in FIG. 2 to a radially outwardly bowed position shown for the bottom rib 34 in FIG. 3 (and later, for all of the ribs 34, as shown in FIG. 4). FIG. 3 shows a pushrod 58 engaging and displacing the bottom rib 34 of the cage in the direction of the arrow 57 to form a bow spring having a generally arcuate center portion. A die 91 may be disposed into position to receive and shape the bow spring 34 as the pushrod 58 is applied to shape the rib into a bow spring. The die 91 may be integral with or separate from the support members 90.

The cage of FIGS. 2-3 cut from the tube 80 of FIG. 1 has five equi-angularly distributed ribs 34, but could have any number of ribs and function well in this application. A centralizer blank 6' having an even number of equi-angularly distributed ribs will not have an elongate aperture directly (180 degrees) across the centralizer blank 6' from it for introduction of the pushrod 58, and these types of centralizer blanks 6' may require the use of two pushrods applied through separate elongate apertures and displaced against a rib 34 simultaneously. In another embodiment, the radially outward displacement of the ribs 34 may be accomplished using an inflatable hydraulic or pneumatic bladder positioned generally in the center of the cage and enlarged or inflated to expand and shape the ribs into bow springs 34 like those shown in FIG. 4. In still another embodiment, the bow springs 34 may be formed by positioning a substantially compressible cylinder of elastomeric material within the cage with the diameter of the cylinder of material approaching the inside diameter of the tubular portions 80, and then axially compressing the cylinder of material from each end to cause it to bulge outwardly to engage and radially outwardly displace the ribs. In yet another embodiment, the ribs 34 may be formed into bow springs 34 by inserting a shaft having splines along a first portion that are reversed from splines along a second portion, the first portion receiving a first threaded collar and the second portion receiving a second threaded collar, the first and the second threaded collars coupled one to the other through a plurality of angularly distributed spreader links so that when the shaft is rotated within the spreader assembly, the first and the second collars are adducted one toward the other to deploy the spreader links radially outwardly and away from the threaded shaft to engage and displace the ribs and to form the ribs into bow springs. These are a few of the number of methods in which the straight ribs may be formed into bow springs 34, and all such methods are within the scope of the present invention.

FIG. 4 is a side elevation view of the cage of FIG. 3 after the pushrod 58 has been used to displace and form each rib 34 (see FIG. 2) into a bow spring (see element 50 in FIG. 3), and after excess end portions of the tube 80 are cut along line 82 (see FIG. 3) and removed from the centralizer blank 6'. The bow springs 34 are preferably metallurgically treated to impart favorable mechanical properties to the bow springs 34. Specifically, the ribs 34 (see FIG. 2) may be displaced to form a bow spring 34, heated to an elevated temperature for a period of time, and then subsequently quenched to a lower temperature in a water or oil bath to impart desirable metallurgical grain size that provides favorable resiliency. It is within the scope of this disclosure to use a variety of treatments known in the metallurgical arts for imparting favorable mechanical properties to the bow springs 34 of the centralizer of the present invention.

FIG. 4 also shows the remaining end portions 80 of the tube 80 adjacent each end of the bow springs 34 with patterns 8' superimposed to illustrate the cuts to be made to the end portions 80 to form an extendable collar adjacent each end of the bow springs 34. The two generally tubular members to be made by cutting in accordance with the superimposed patterns in FIG. 4 are two stop collars 10' and two moving collars 20'. As seen in FIG. 4, the cutting of the end portions of the tube 80 in accordance with the superimposed pattern enables the removal of a plurality of material coupons 52' from the tube wall to form extendable collars 8' (see element 8 in FIG. 5) adjacent to each end of the bow springs 34 and epoxy retaining apertures 30 (see FIG. 5) adjacent to each end of the centralizer blank 6'.

Figure 5:
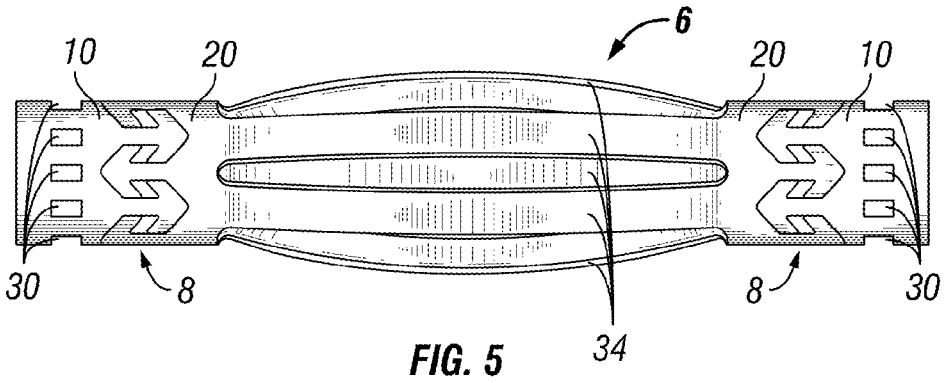
FIG. 5 is an elevation view of a centralizer formed from the cage and tube portions shown in FIG. 4 by cutting according to the superimposed patterns to form an extendable collar from each tube portion adjacent to each end of the cage with bow springs.

FIG. 5 is an elevation view of the centralizer blank 6' of FIG. 4 after the cutting tool is used to cut in accordance with the patterns 8' of FIG. 4 and the material coupons are removed to form the moving collars 20, the stop collars 10 and the epoxy retaining apertures 30.

Figure 6:
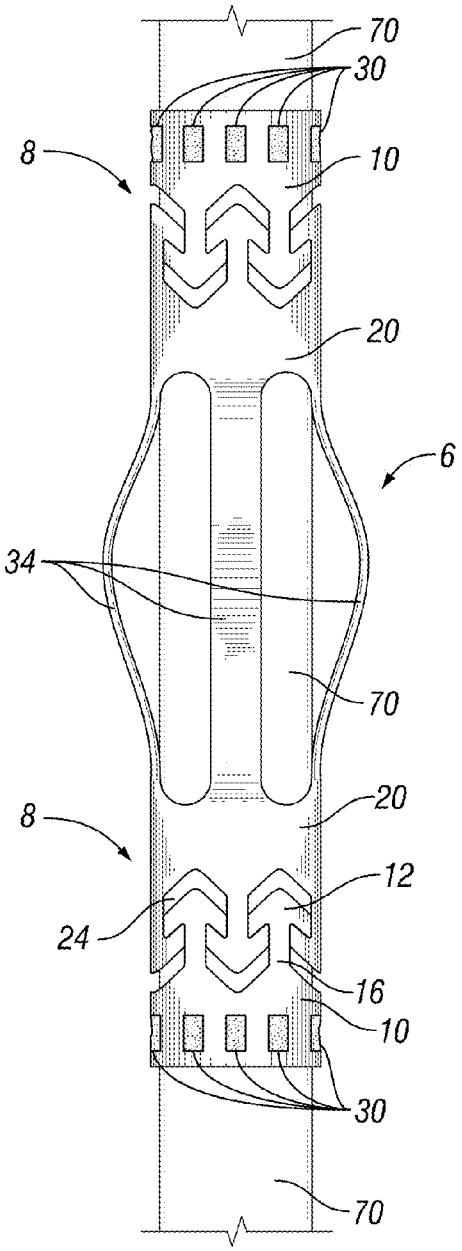
FIG. 6 is an elevation view of the centralizer of FIG. 5 received and secured on a casing for being installed in a borehole.

FIG. 6 is an elevation view of the centralizer 6 of FIG. 5 received on a casing 70 for being installed in a borehole. The centralizer 6 is securable to the casing 70 in a number of ways, including the use of set screws which tighten to grip the casing 70 within the stop collar 10. In an embodiment, the centralizer 6 may secured to the casing 70 by use of epoxy adhesive being applied to epoxy retaining apertures 30 where it is allowed to cure. This method of securing a centralizer to a casing is described in more detail in a patent application filed on Jun. 28, 2006 and assigned U.S. Ser. No. 11/427,251, and is incorporated by reference into this disclosure. In another embodiment, the centralizer 6 may be secured to the casing 70 using a thermal spray, metal deposition process, as will be described in greater detail below with respect to FIGS. 15-23. Although described below with respect to other embodiments, it will be appreciated that the epoxy retaining apertures 30 may be employed with sprayed metal, rather than or in addition to the epoxy.

The bow springs 34 are shown in their radially outwardly deployed configuration to provide stand-off from an interior wall of the borehole during installation of the casing 70 into a borehole. Each of the upper and lower extendable collars 8 are shown in the extended configuration as the deployed bow springs 34 pull the moving collars 20 toward the center portion of the centralizer 6 and away from the stop collars 10 that are secured to the exterior of the casing 70.

Figure 7:
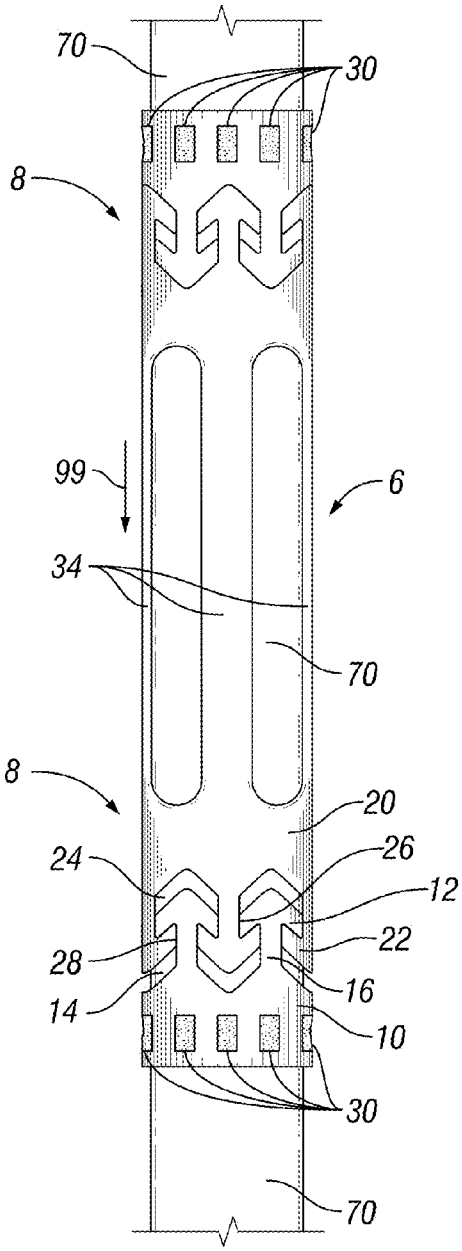
FIG. 7 is the centralizer and casing of FIG. 6 with the bow springs of the centralizer collapsed to lie along a portion of the exterior of the casing and the upper extendable collar retracted to receive a portion of the arc length surrendered by the bow springs upon collapse.

FIG. 7 is the centralizer 6 and casing 70 of FIG. 6 with the bow springs 34 of the centralizer 6 collapsed to lie in a generally linear condition along a portion of the exterior of the casing 70 and the upper extendable collar 8 receiving a portion of the arc length surrendered by the bow springs 34 upon collapse. This configuration is that which the centralizer 6 is likely to exhibit when the casing 70 is installed into a borehole and the centralizer 6 encounters a borehole restriction through which the centralizer 6 must pass. The configuration of the centralizer 6 shown in FIG. 7 results from the casing 70 being lowered in the direction of the arrow 99 into a borehole with the bottom or lower extendable collar 8 shown in FIG. 6 being the leading collar and the top or upper extendable collar 8 being the trailing collar. As the bow springs 34 encounter borehole restrictions or protrusions from the interior wall of the borehole that require the bow springs 34 to collapse inwardly toward the casing 70, the resistance of the bow springs 34 to collapse causes the leading extendable collar 8 to be extended. As the bow springs are further collapsed to their configuration shown in FIG. 7, at least a portion of, the arc length of the deployed bow springs 34 (see FIG. 6) is surrendered and absorbed by retraction of the trailing extendable collar 8, which is shown in the retracted configuration in FIG. 7. The trailing or upper extendable collar 8 in FIG. 7 is shown to be fully retracted, that is, there is no capacity of the trailing extendable collar to be further retracted. It is preferred that the extendable collar be structured with excessively sized chambers (see element 24 in FIG. 6) so that an accumulation of dirt or debris within the chamber during installation of the casing 70 in a borehole would not prevent movement of the head (see element 12 of FIG. 6) into the chamber 24 that would prevent the bow springs 34 of the centralizer 6 from fully collapsing to pass through a borehole restriction.

Figure 8:
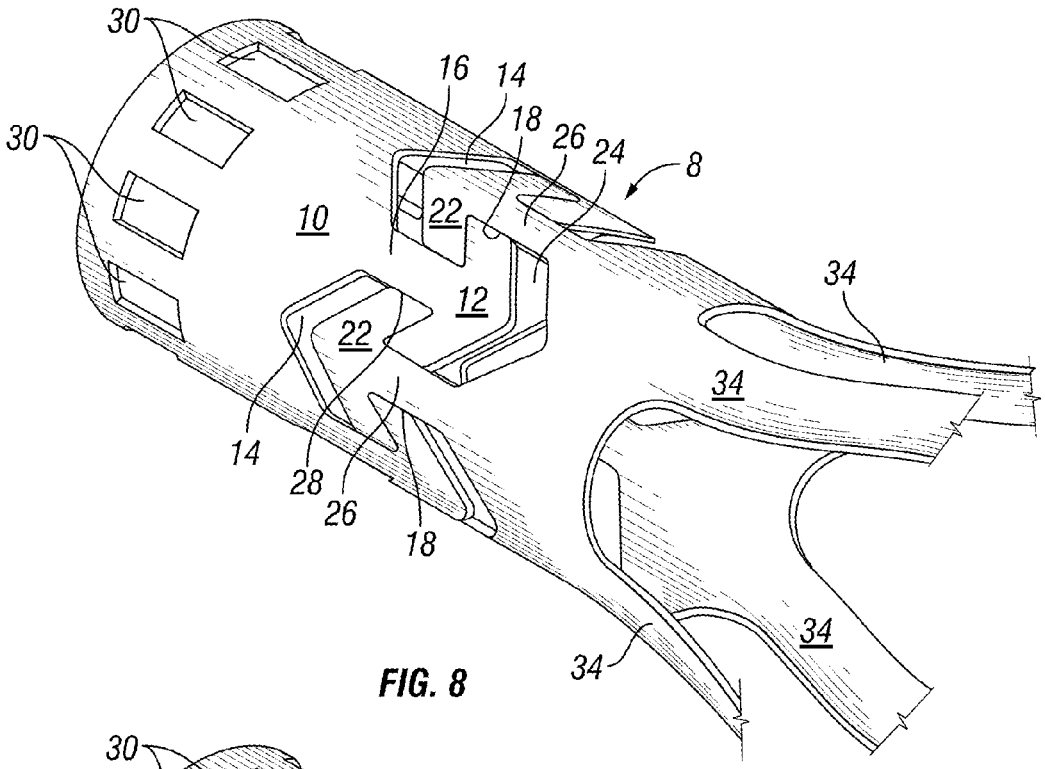
FIG. 8 is a perspective view of one of the extendable collars of the centralizer of FIG. 6 in the extended position.

FIG. 8 is an enlarged perspective view of one of the extendable collars 8 of the centralizer 6 of FIG. 6, or the lower or leading extendable collar 8 of the centralizer 6 of FIG. 7, all of which are shown in the extended position. FIG. 8 shows the interlocking interrelationship of the heads 12 and 22 of the stop collar 10 and the moving collar 20, respectively, of the heads 12 of the stop collar 10 and the extensions 26 of the moving collar 20, and of the heads 22 of the moving collar 20 and the extensions 16 of the stop collar 10. The extended position of the extendable collar 8 shown is FIG. 8 is the configuration of the extendable collars in a centralizer 6 of the present invention when the bow springs 34 are deployed to pull the moving collars 20 inwardly toward the center of the centralizer 6, as shown in FIG. 6. In another example, the extended position of the extendable collar 8 shown is FIG. 8 is the configuration of the leading extendable collar in a centralizer 6 of the present invention when the centralizer 6 is being drawn through a borehole restriction or past a borehole protrusion that presents an obstacle for the bow springs to pass in their deployed condition. An extendable collar will generally be a leading collar if it is the bottom extendable collar of the centralizer 6 being lowered into a borehole on a casing or, if it is the trailing collar, if it is the top extendable collar of the centralizer 6 being pulled upwardly toward the surface through a borehole restriction or past a interior wall of the borehole protrusion that presents an obstacle for the bow springs to pass in their deployed condition.

Figure 9:
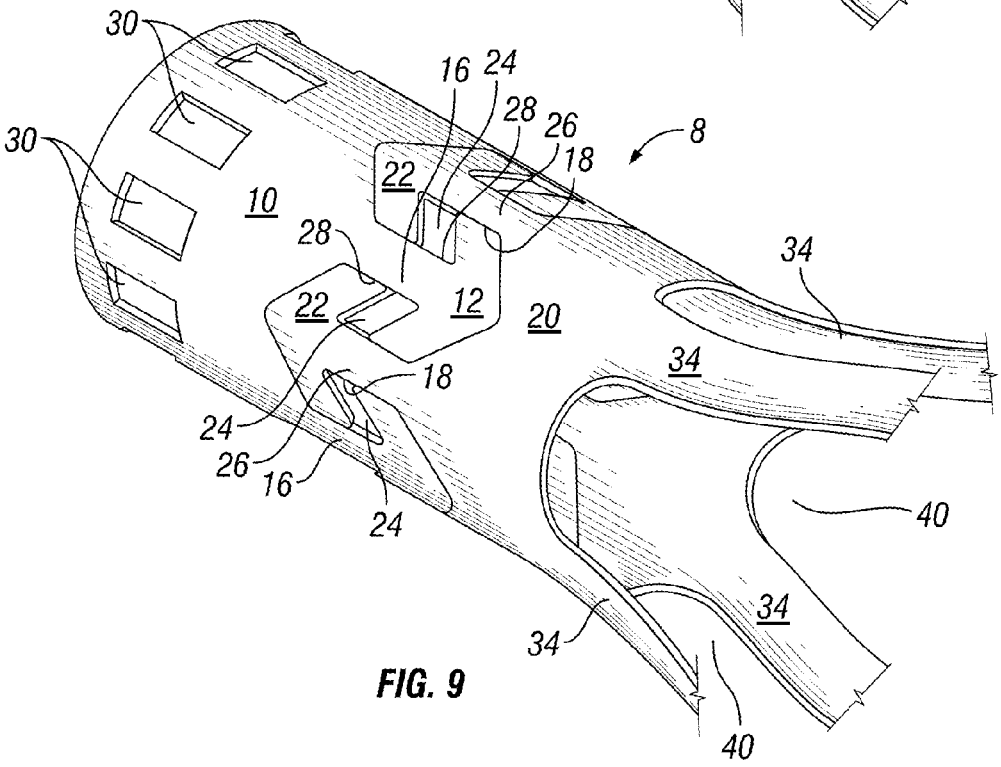
FIG. 9 is a perspective view of the lower extendable collar in FIG. 7 in the retracted position.
Figure 10:
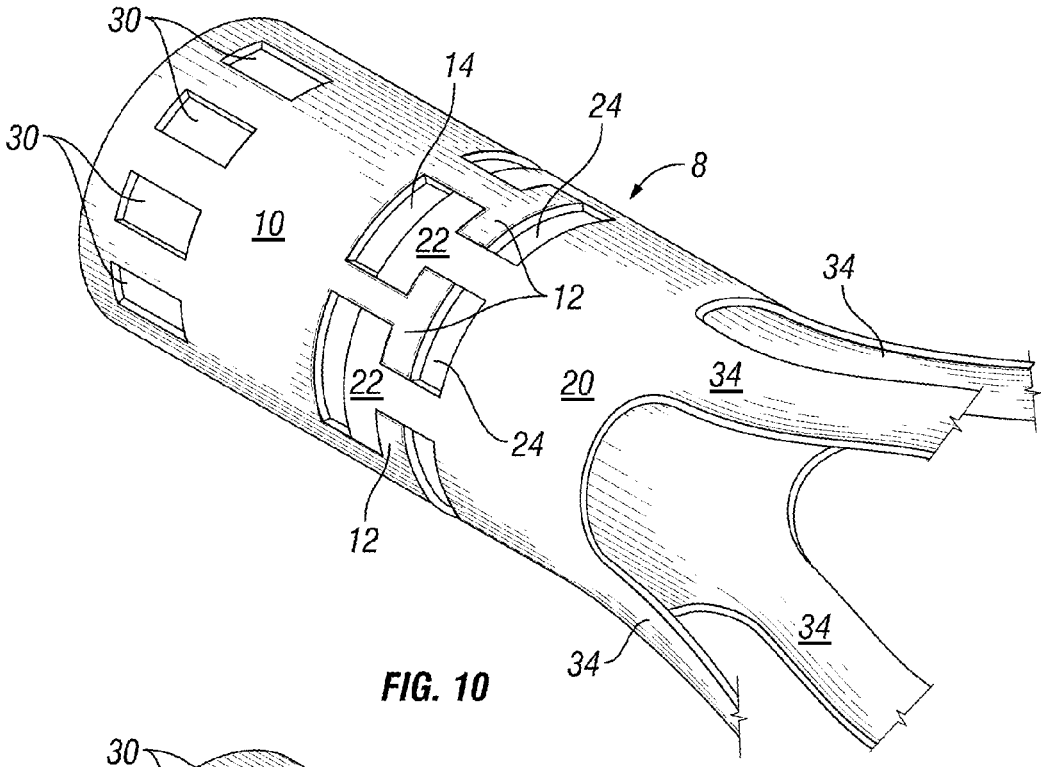
FIG. 10 is a perspective view of an alternate embodiment of an extendable collar of a centralizer of the present invention in the extended position.

FIG. 10 is a perspective view of an alternate embodiment of an extendable collar 8 portion of a centralizer 6 of the present invention in the extended position like the embodiment shown in FIG. 8. The alternate embodiment shown in FIG. 10 has a plurality of generally rectangular-shaped heads 12, 22 and chambers 14, 24 (when viewed as projected onto a plane) as compared to the generally arrow-shaped heads and chambers of the embodiment of FIGS. 6-9.

FIG. 9 is an enlarged perspective view of the upper or trailing extendable collar 8 of the centralizer 6 of FIG. 7 in the retracted position. It is clear that the removal of a generally larger coupon of material from the wall of the tube 80 used to make the centralizer 6 and to form the chamber (see element 14 in FIG. 8) will minimize the potential for an accumulation of debris clogging or otherwise preventing full retraction of the extendable collar 8. Similarly, the removal of a generally larger coupon of material from the wall of the tube 80 used to make the centralizer 6 and to form the chamber (see element 24 in FIG. 9) will minimize the potential for an accumulation of interior wall of the borehole debris clogging or otherwise preventing full extension of the extendable collar 8.

Figure 11A:
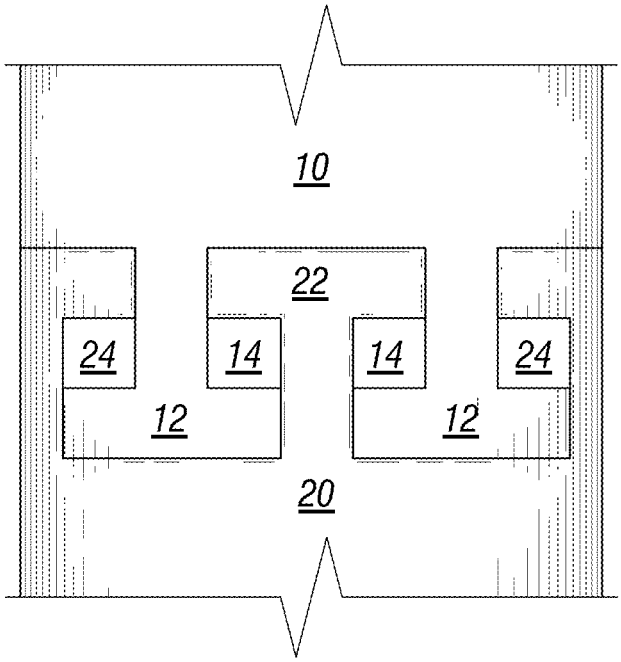
FIG. 11A is a flattened, plan view of the interlocked portion of the extendable collar of the centralizer of the present invention in the retracted position, taken along section lines A-A of FIG. 11.
Figure 11:
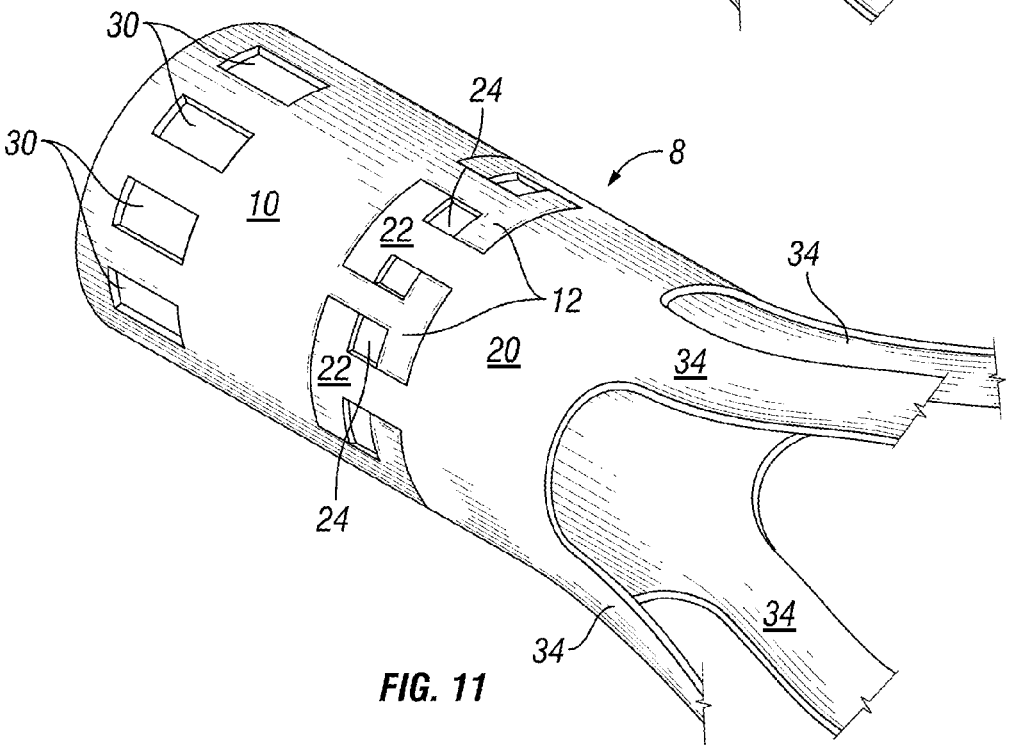
FIG. 11 is a perspective view of the axially extendable collar of FIG. 10 in the retracted position.

FIG. 11 is a perspective view of the alternate embodiment of the axially extendable collar of the centralizer 6 of the present invention of FIG. 10 in the retracted position like the embodiment shown in FIG. 9.

Figure 9A:
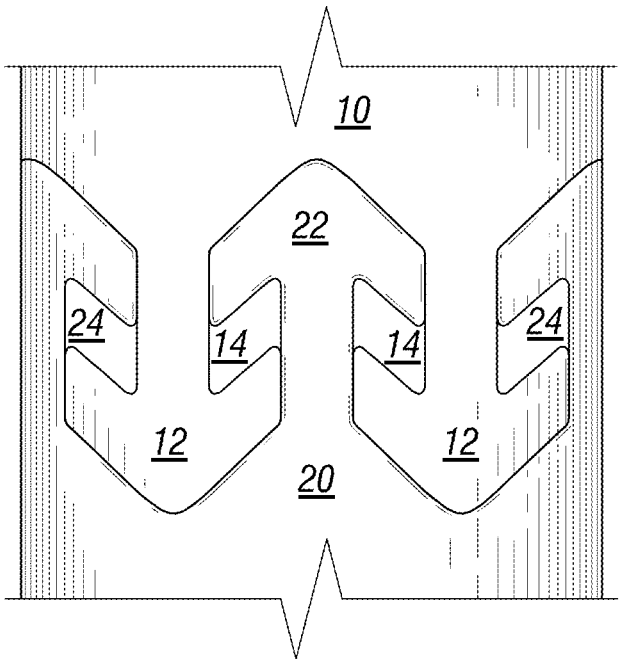
FIG. 9A is a flattened, plan view of the interlocked portion of the extendable collar of the centralizer of the present invention in the retracted position, taken along section lines A-A of FIG. 9.

FIG. 9A is a flattened, plan view of the interlocked portion of the extendable collar in the fully contracted position, taken along section lines A-A of FIG. 9.

FIG. 11A is a flattened, plan view of the interlocked portion of the extendable collar taken along section lines A-A of FIG. 11.

Figure 12:
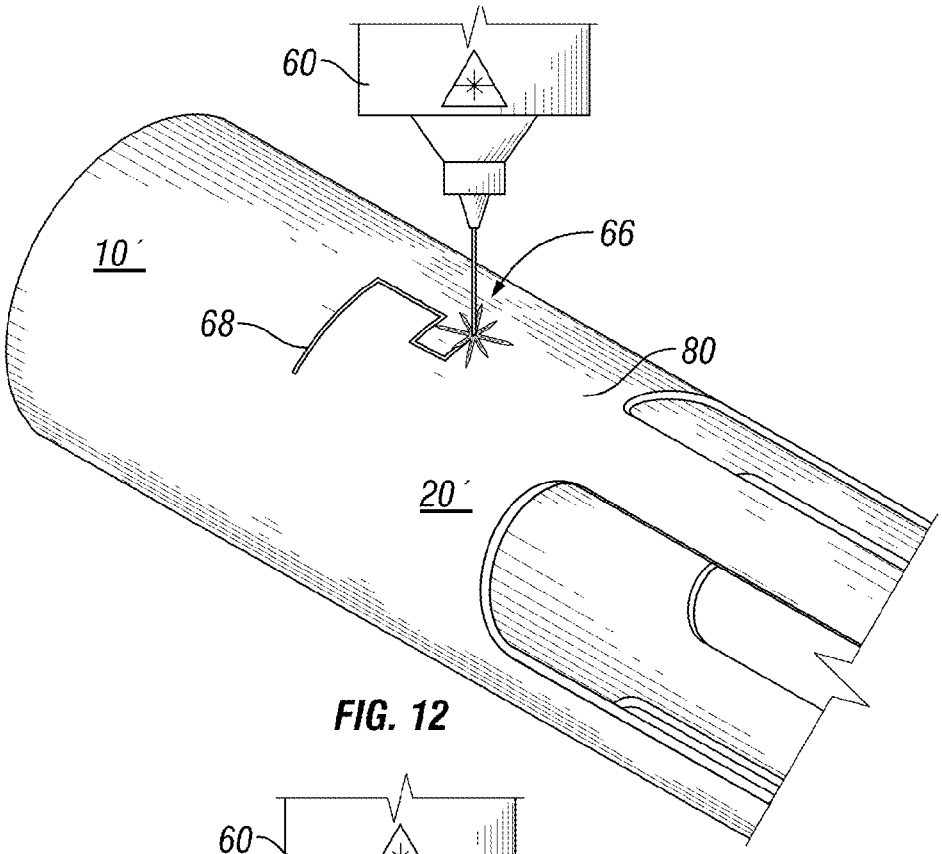
FIG. 12 is a perspective view of a tube being cut by a laser to form an extendable collar of one embodiment of the centralizer of the present invention.

FIG. 12 is a perspective view of a tube 80 being cut along a pattern 68 by a laser device 60 to form an embodiment of the extendable collar 8 of the centralizer 6 of the present invention. The laser beam 66 contains sufficient energy to cut through the wall of the tube 80 without significantly cutting or affecting the opposing diameter wall when the laser beam 66 penetrates the targeted wall. The first portion 10' of the segment of tube 80 being cut in FIG. 12 will form the stop collar 10 (see FIGS. 2-11) and the second portion 20' of the segment of tube 80 being cut in FIG. 12 will form the moving collar 20 of the centralizer 6. A variety of lasers capable of cutting metal tubulars are known in the art, and an in-depth discussion of lasers is therefore not warranted herein. As an overview, any suitable type of laser may be used to cut through the wall of a tube according to the present invention. The resulting cut is clean, square and generally distortion-free. Most laser cutting requires short setup times and requires little or no finishing.

Figure 13:
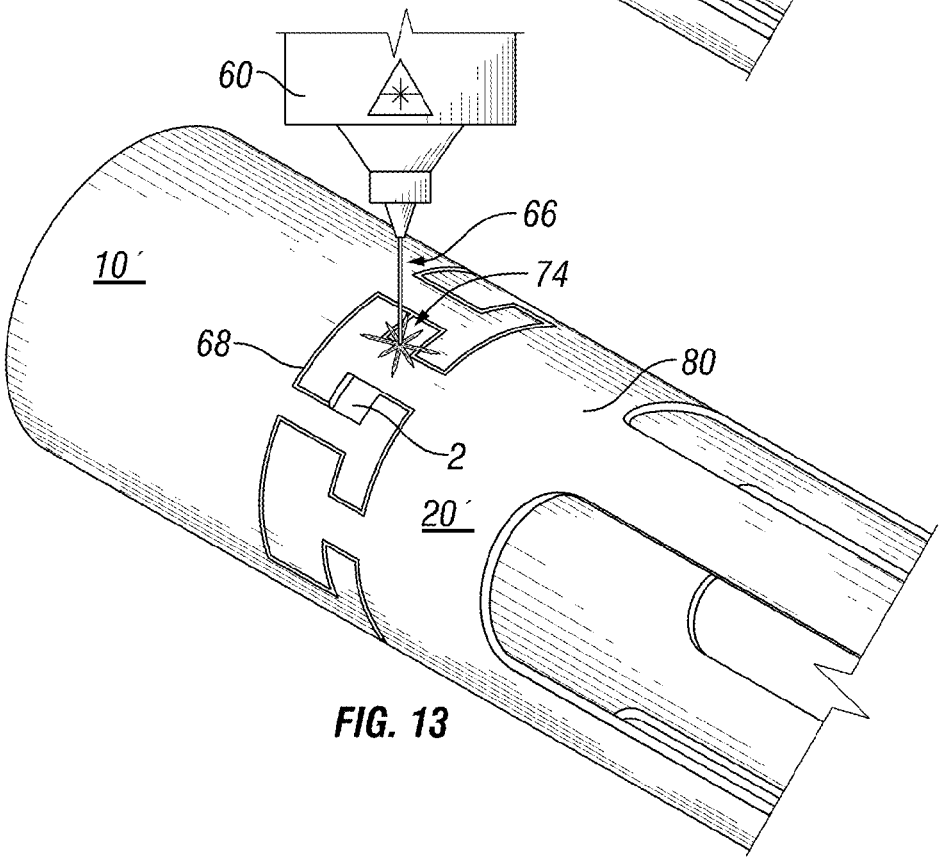
FIG. 13 is a perspective view illustrating the strategic removal of material coupons from the wall of the tube of FIG. 12 to form an extendable collar from the tube.

FIG. 13 is a perspective view illustrating the strategic removal of a material coupon 74 from the wall of the tube 80 of FIG. 12 to form an extendable coupling 8 from the tube 80.

Figure 14:
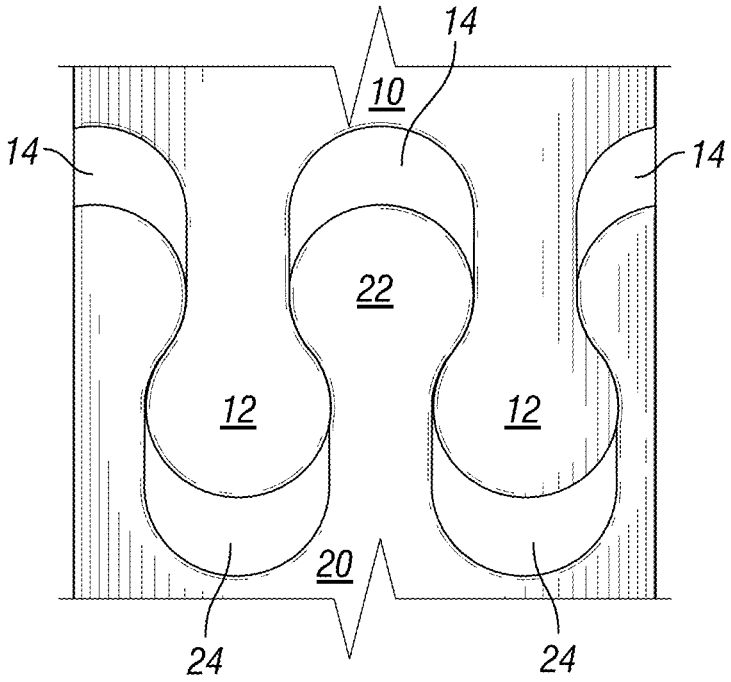
FIG. 14 is a flattened, plan view of the interlocked portion of an embodiment of the extendable collar.

FIG. 14 is a side view illustrating the heads 12 having a bulbous shape and fitting into elongated chambers 24. The elongated chambers 24 are shaped such that the heads 12 slide therein, while being generally constrained from rotation (i.e., lateral movement in the illustrated view).

Figure 15:
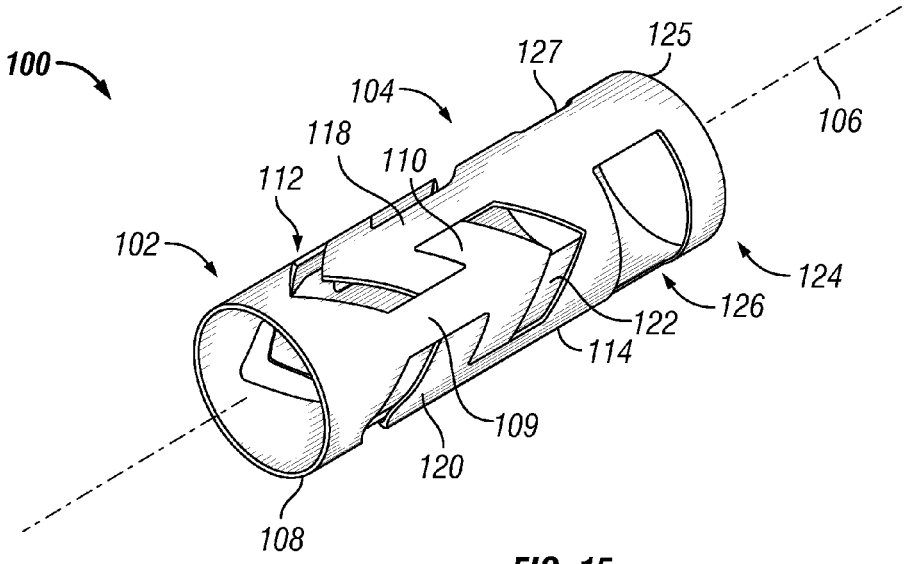
FIG. 15 is a perspective view of an extendable collar, according to an embodiment.

FIG. 15 is a perspective view of another stop collar 100, according to an embodiment. The stop collar 100 may be formed from the single tubular 80, e.g., using laser or water jet cutting, as described above, or using any other type of cutting process. In other embodiments, the stop collar 100 may be formed in two or more pieces that are fit, attached, or otherwise coupled together.

The stop collar 100 may include a first portion 102 and a second portion 104 that are slidable one relative to the other, e.g., along a longitudinal axis 106 of the stop collar 100, as shown. In an embodiment, the first portion 102 may include an annular base 108, from which a plurality of extensions 109 extend along the longitudinal axis 106. The plurality of extensions 109 may include or otherwise terminate with heads 110. The heads 110 may each be generally shaped as an arrow-head, as shown, but in other embodiments may be square, rectangular, bulbous, or provided in any other suitable shape. Moreover, each of the heads 110 may be uniform, or the shapes of the heads 110 may vary in a single embodiment. Further, between axially adjacent extensions 109 and heads 110 may be defined chambers 112. For example, the extensions 109 and heads 110 may form at least some of the walls defining the chambers 112.

Likewise, the second portion 104 may include an annular base 114, from which a plurality of extensions 118 extend, e.g., along the longitudinal axis 106. The extensions 118 may include or otherwise terminate with heads 120. The heads 120 may be generally the same shape as the heads 110; however, in other embodiments, the two sets of heads 110, 120 may have different shapes. Between adjacent pairs of heads 120 and extensions 118, there may be defined chambers 122.

The chambers 122 of the second portion 104 may be sized to receive the heads 110 of the first portion 102, while the chambers 112 of the first portion 102 may be sized to receive the heads 120 of the second portion 104. Moreover, the chambers 112, 122 may have an axial dimension that exceeds an axial dimension of the heads 120, 110, respectively, such that the heads 120, 110 are slidable along the axis 106 while disposed in the chambers 112, 122, respectively. Further, a circumferential distance between adjacent heads 110, 120 may be smaller than a circumferential dimension of the heads 120, 110 received into the chambers 112, 122, respectively. Accordingly, the extensions 109, 118 may be interleaved, with the heads 110, 120 thereof interlocking with one another. As such, the heads 110 of the first portion 102 may be slidably disposed and retained in the chambers 122 of the second portion, while the heads 120 of the second portion may be slidably disposed and retained in the chambers 112 of the first portion 102.

The stop collar 100 may expand and contract as the first and second portions 102, 104 slide one relative to the other. As shown, the heads 110, 120 are in engagement; this may define a fully-expanded configuration of the stop collar 100. The first and second portions 102, 104 may be slid toward one another (adduct), which may result in the axial extent of the stop collar 100 being reduced. Eventually, either or both of the heads 110, 120 may reach the end of the chamber 122, 112, respectively, and engage the annular base 114, 108, respectively. This may be the fully-contracted configuration of the stop collar 100, with a multitude of configurations between fully-contracted and fully-expanded being available.

The second portion 104 may also include an anchor 124. The anchor 124 may be coupled with the annular base 114 and extend axially along the longitudinal axis 106 away from the first portion 102. The anchor 124 may define an anchor base 125, which may be offset from the annular base 114 of the second portion 102. Moreover, the anchor 124 may define one or more anchor windows 126 extending radially through the anchor 124 and located between the anchor base 125 and the annular base 114. Any number of anchor windows 126 may be employed, for example, two, as shown. In addition, the anchor windows 126 may be spaced uniformly, according to any pattern, or non-uniformly. The anchor windows 126 may expose a portion of a casing (or any other tubular) received through the stop collar 100, so as to provide access to the portion of the casing, radially inwards through the stop collar 100. Such radially-inward access may facilitate coupling the stop collar 100 to the casing, as will be described in greater detail below. Accordingly, in at least one embodiment, the second portion 104 may be stationary with respect to the casing to which it is attached, while the first portion 102 may generally have a range of axial motion defined by the difference between the axial dimension of the chambers 112, 122 and the heads 120, 110 received therein, respectively.

The anchor windows 126 may occupy a majority of the circumference of the anchor 124, with relatively narrow anchor legs 127 extending circumferentially between the anchor windows 126 and axially between the anchor base 125 and the annular base 114. Moreover, each of the anchor windows 126 may extend across a range of angles around the longitudinal axis 106. In particular, in various embodiments, an individual one of the anchor windows 126 may extend at least about 20 degrees, for example, between about 20 degrees and about 170 degrees, about 50 degrees and about 150 degrees, about 60 degrees and about 140 degrees, or between about 70 degrees and about 130 degrees.

The anchor windows 126 may also define an axial extent that is at least about 30%, at least about 40%, at least about 50%, at least about 60%, at least about 70% or more of the axial extent of the anchor 124 (e.g., between the end of the anchor base 125 and the end of the annular base 114). Further, the anchor windows 126 may define an axial extent that is between about 5% and about 25%, about 10% and about 20%, or about 12% and about 17% of the axial extent of the second portion 104 (from the end of the base 114 to the tip of the head 120). As such, in at least one specific embodiment, the anchor windows 126 may exceed the dimensions suitable for use with screws or an epoxy, as with the epoxy retaining apertures 30 discussed above.

In some embodiments, the anchor windows 126 may be of uniform size, but in others, one or more of the anchor windows 126 may be formed of different sizes. Moreover, although the illustrated anchor window 126 has a generally constant axial width (e.g., formed as an area between two parallel and aligned arcs along the anchor 124), it will be appreciated that any other suitable shape, e.g., diamond, star, otherwise polygonal, circular, elliptical, etc. may be employed.

Although two portions 102, 104 are illustrated, it will be appreciated that embodiments including three or more portions 102, 104, whether relatively slidable, and/or rotational, etc. are contemplated herein. For example, although not illustrated, a third portion may be provided to increase an axial range of motion, without departing from the scope of the present disclosure.

Figure 16:
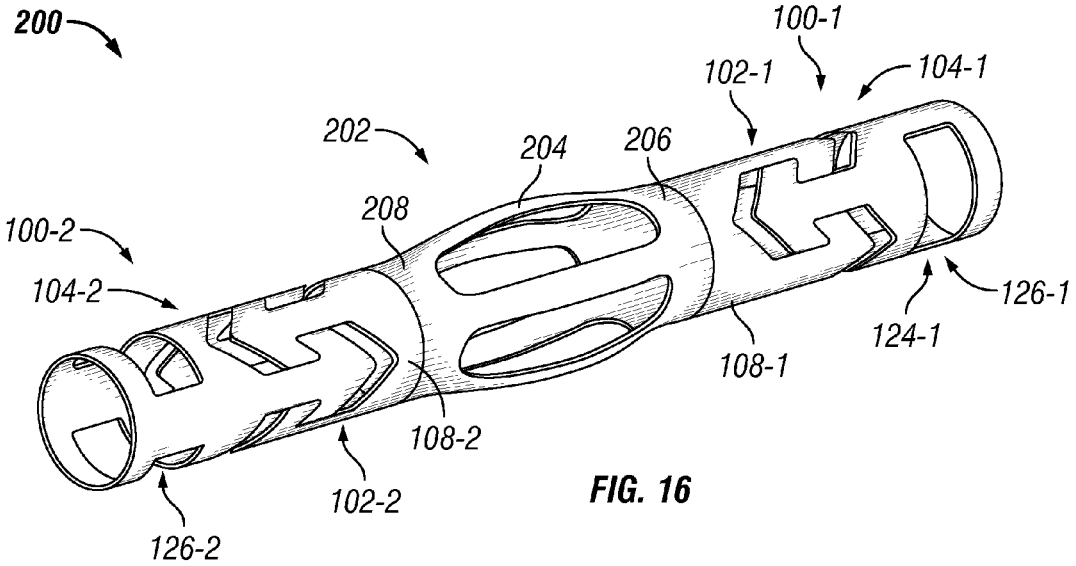
FIG. 16 is a perspective view of a centralizer assembly including two of the extendable collars of FIG. 15, according to an embodiment.

FIG. 16 is a perspective view of a centralizer assembly 200, according to an embodiment. As illustrated, the centralizer assembly 200 may include two of the stop collars 100 (indicated by reference numbers 100-1 and 100-2 in FIG. 16). In other embodiments, however, the centralizer assembly 200 may include a single one of the stop collars 100 and may or may not include an additional stop collar of any other suitable configuration.

The centralizer assembly 200 also includes a bow-spring centralizer 202 disposed axially (e.g., along the axis 106 of FIG. 15) intermediate the two stop collars 100-1, 100-2. The bow-spring centralizer 202 may include a plurality of flexible ribs 204 (bow springs), which are circumferentially offset from one another. Further, the bow-spring centralizer 202 may include end collars 206, 208, which may be annular and axially offset from one another. The ribs 204 may extend between the end collars 206, 208 and may be integral therewith. For example, the ribs 204 and end collars 206, 208 may be cut from a single tubular, as described above, or may be formed from a sheet or plate of metal, which is then rolled and welded, e.g., as described in U.S. patent application having Ser. No. 13/957,016, which is incorporated herein by reference in its entirety, to the extent not inconsistent with the present disclosure. In other examples, the ribs 204 may be separately formed from the end collars 206, 208 and attached thereto, e.g., via welding, fasteners, adhesives, and/or any other process.

The ribs 204 may be resiliently biased towards a curved profile, such that they extend radially outward from, in addition to axially between, the end collars 206, 208. Such resilient biasing may be provided by heat treating, etc., for example, as described above. Accordingly, the ribs 204 may provide a range of generally elastic expansion and contraction for providing an annular setoff between a casing (or another tubular) received through the assembly 200 and a surrounding tubular, e.g., a wellbore.

Further, the end collars 206, 208 may bear on the annular bases 108-1, 108-2 of the first portions 102-1, 102-2 of the stop collars 100-1, 100-2, respectively. Since, in an embodiment, the length of the ribs 204 may remain generally constant during normal operation, the end collars 206, 208 may require an axial range of motion to account for the outward flexing and inward compression of the ribs 204. That is, when the ribs 204 flex radially outwards, the end collars 206, 208 may be drawn closer together, while when the ribs 204 compress radially inwards, the end collars 206, 208 may be pushed apart.

In an embodiment, the centralizer 202 may be fixed to the stop collars 100-1, 100-2, so as to prevent or at least limit relative rotation and/or axial displacement of the centralizer 202 relative to the stop collars 100-1, 100-2. In some cases, the centralizer 202 may be axially displaceable from one or both of the stop collars 100-1, 100-2 by a range, while rotatable relative thereto. For instance, the end collars 206, 208 may include a lip portion (not shown) that mates with a corresponding lip portion (not shown) on the stop collars 100-1, 100-2. The lip portions interconnect the end collars 206, 208 of the centralizer and the stop collars 100-1, 100-2 while allowing rotational movement between the centralizer 202 and the stop collars 100-1, 100-2. The lip portions may act as a bearing member between the centralizer 202 and the stop collars 100-1, 100-2. In another embodiment, a separate bearing member (not shown) may be placed between the centralizer 202 and each stop collar 100-1, 100-2 to allow for rotational movement of the centralizer 202 relative to the stop collars 100-1, 100-2. In a further embodiment, a stop collar as described in U.S. Pat. No. 6,679,325, which is incorporated by reference in its entirety herein, to the extent not inconsistent with the present disclosure, may be used with the centralizer 202. In other examples, the end collars 206, 208 may be relatively rotatable with respect to the annular bases 108-1, 108-2, but may be prevented from axial displacement therefrom. In still other embodiments, the end collars 206, 208 may be fixed to the bases 108-1, 108-2, such that rotation and translation are prevented. In at least one example, the end collars 206, 208 may be integrally-formed as a single piece with the annular bases 108-1, 108-2, respectively. In another example, the end collars 206, 208 may be welded, fastened, threaded, adhered, brazed, or otherwise secured to the annular bases 108-1, 108-2, so as to positionally fix the end collars 206, 208 to the annular bases 108-1, 108-2.

Moreover, the anchors 124-1 and 124-2 may be secured to the casing, such that the second portions 104-1, 104-2 are generally fixed in position relative to the casing. In effecting such securing, the first and second collars 100-1, 100-2 may be circumferentially offset (clocked) relative to one another, such that anchor windows 125-1, 125-2 and/or any other components of the first and second collars 100-1, 100-2 are clocked relative to one another. Accordingly, in embodiments in which the centralizer 202 is prevented from axial displacement relative to first and second stop collars 100-1, 100-2, the sliding range of motion between the fully-expanded and fully-contracted configurations of the stop collars 100-1, 100-2 may provide the range of axial motion for separating or adducting the end collars 206, 208 to accommodate the flexure of the ribs 204.

Figure 17:
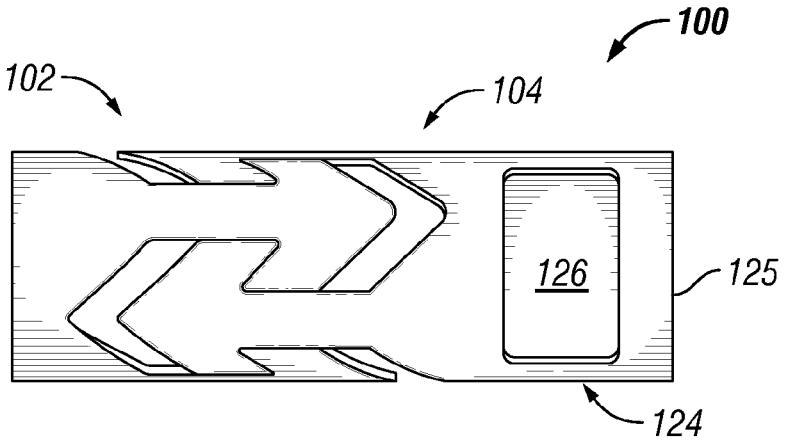
FIG. 17 is a side elevation view of the extendable collar of FIG. 15, according to an embodiment.
Figure 18:
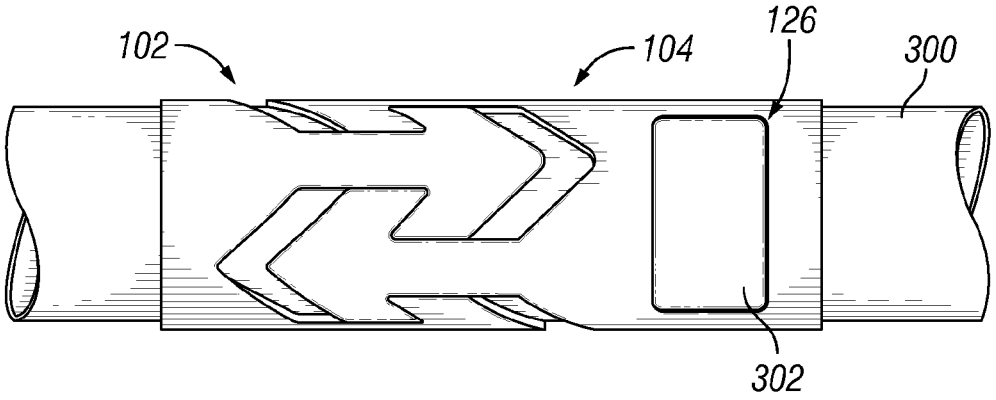
FIG. 18 is a side elevation view of the extendable collar of FIG. 15, with the collar attached to a tubular, according to an embodiment.

FIGS. 17 and 18 are two side-views of the stop collar 100, according to an embodiment. In particular, FIG. 17 illustrates the stop collar 100 prior to attachment to a tubular, while FIG. 18 illustrates the stop collar 100 attached to a tubular 300. One example of such a tubular 300 may be a casing. As can be appreciated in FIG. 17, the anchor window 126 extends radially through (e.g., through a wall thickness) of the anchor 124.

In FIG. 18, the window 126 is filled with an anchoring material 302 that is, for example, received radially inwards through the anchor window 126. The anchoring material 302 may be fixed to the tubular 300. In an example, the anchoring material 302 may be a metal deposited by a thermal spray process. Examples of such thermal spray processes, compositions therefor, etc. are provided in U.S. Pat. No. 7,487,840, which is incorporated herein by reference in its entirety, to the extent not inconsistent with the present disclosure. Briefly, such a thermal spray process may proceed by supplying a wire composed of a blend of powder, metals, etc. to an electrical arc, e.g., between two electrodes in a spray gun. A flow of air or another gas may also be provided, such that, when the wire contacts the arc, the wire melts and the molten metal is projected toward the surface of the tubular 300 through the anchor window 126 by the flow of air. The molten metal, as it is projected toward the surface of the tubular 300, may be formed in small droplets, which contain insufficient energy to raise the temperature of the tubular 300, even locally, to temperatures which might affect the metallurgy of the tubular 300.

The anchoring material 302 may be built up, e.g., by multiple passes of the spray gun, allowing each layer to solidify and act as a base for the layer deposited by a subsequent pass. Accordingly, the anchoring material 302 may extend outwards from the tubular 300 to a thickness sufficient to provide a bearing surface for the anchor 124. In some cases, the thickness of the anchoring material 302 may equal or exceed the thickness of the stop collar 100. However, in other cases, the anchoring material 302 may have a thickness that is less than the thickness of the stop collar 100.

Accordingly, the anchor window 126 may be shaped and configured for receiving the anchoring material 302 therethrough. Without being bound by theory, for example, the anchor window 126 may have a dimension (e.g., a circumferential dimension) that is large enough to allow the molten anchoring material 302 to solidify prior to a subsequent layer of anchoring material 302 being deposited, while maintaining a generally constant rate of material deposition.

In an embodiment, the anchoring material 302 may occupy all or nearly all of the area available in the anchoring window 126. Thus, once formed, the anchor base 125 and the annular base 114 of the second portion 104 may be prevented from axial movement, thereby axially anchoring the second portion 104 in either axial direction. Further, the portions of the anchor 124 defining the circumferential walls of the anchor windows 126 (e.g., the portions of the anchor 124 extending axially between the anchor base 125 and the annular base 114) bear on either circumferential side of the anchoring material 302, thereby preventing rotational relative to the tubular 300. Thus, in an embodiment, the second portion 104 may be fixed in position relative to the tubular 300 via the anchoring material 302 disposed in the anchor window 126.

Although the illustrated embodiment shows the anchoring material 302 substantially filling the anchor window 126, in other embodiments, the anchoring material 302 may fill a portion of the anchor window 126, while leaving another portion empty. For example, the axial width of the window 126 may be greater than the axial width of the anchoring material 302. Additionally, a circumferential extent of the anchoring material 302 may be less than the circumferential dimension of the anchor window 126.

Moreover, the anchoring material 302 may not rely on engagement with the anchor 124 to grip the tubular 300. The thermal spray process may result in the anchoring material 302 having sufficient holding force. Thus, unlike with a grub screw or teeth, shim, interference fits, etc., the anchoring material 302 may not rely on the hoop strength of the anchor 124 to provide a radially inward gripping force on the anchoring material 302. Moreover, in such case, the anchoring material 302 may not requires threads or other structures to engage the anchor 124 and apply such inwardly-directed gripping force.

Figure 19:
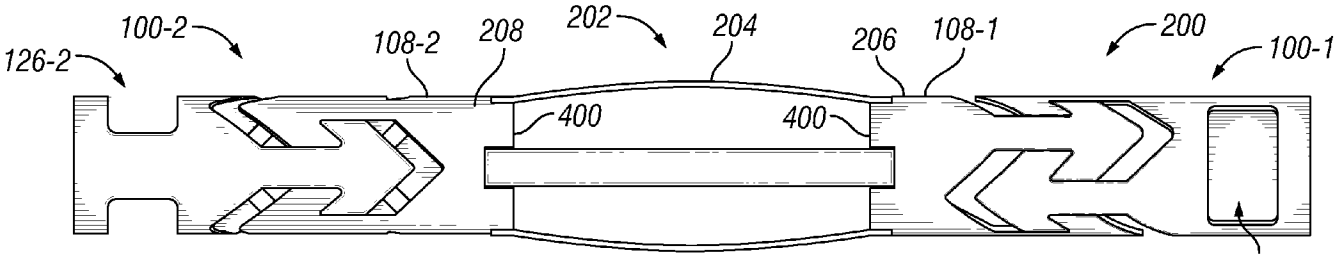
FIGS. 19-21 illustrate side elevation views of three centralizer assemblies, each with two of the extendable collars, according to various embodiments.
Figure 20:
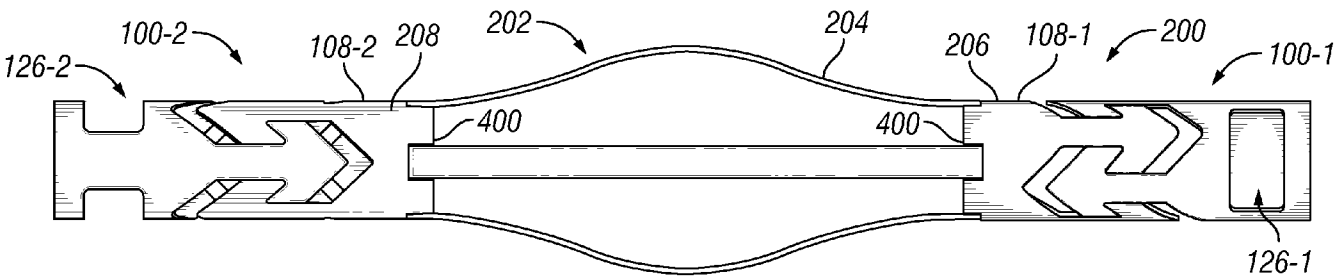
Figure 21:
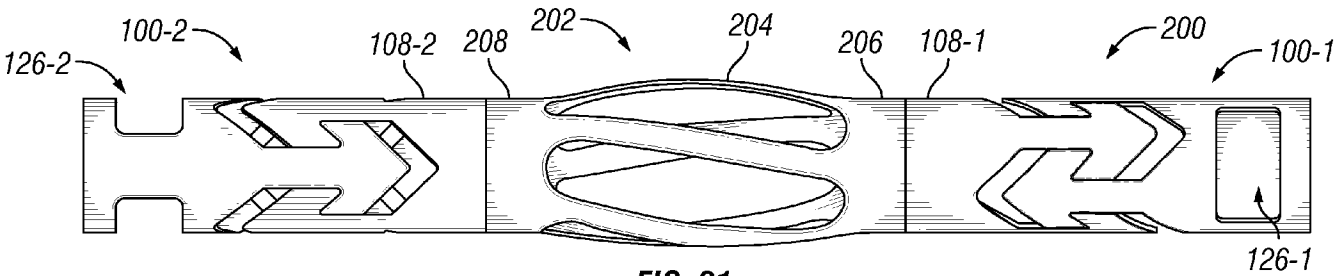

FIGS. 19-21 illustrate three additional embodiments of the centralizer assembly 200. In FIG. 19, the ribs 204 are separately formed from the end collars 206, 208 and attached to the end collars 206, 208 in notches 400 formed in the end collars 206, 208. The ribs 204 may be welded to the end collars 206, 208 in the notches 400, or may be attached to the end collars 206, 208 in any other manner. As shown, the end collars 206, 208 may be integral with the annular bases 108-1, 108-2 or formed separately therefrom.

Similarly, in FIG. 20, the ribs 204 are separately formed from the end collars 206, 208 at attached thereto at the notches 400. The ribs 204 in FIG. 20 may be longer than those in FIG. 19, and may extend radially outward to a greater extent, thereby providing a larger standoff between the casing (or other tubular) received through the assembly 200. Further, FIG. 21 illustrates the ribs 204 disposed in a generally helical orientation, such that the ribs 204 are angularly offset between where they connect to the end collar 206 and where they connect to the end collar 208. In such a helical configuration, the ribs 204 may be integral with the end collars 206, 208 or may be coupled thereto, e.g., at notches 400 as shown in FIGS. 19 and 20.

Figure 22:
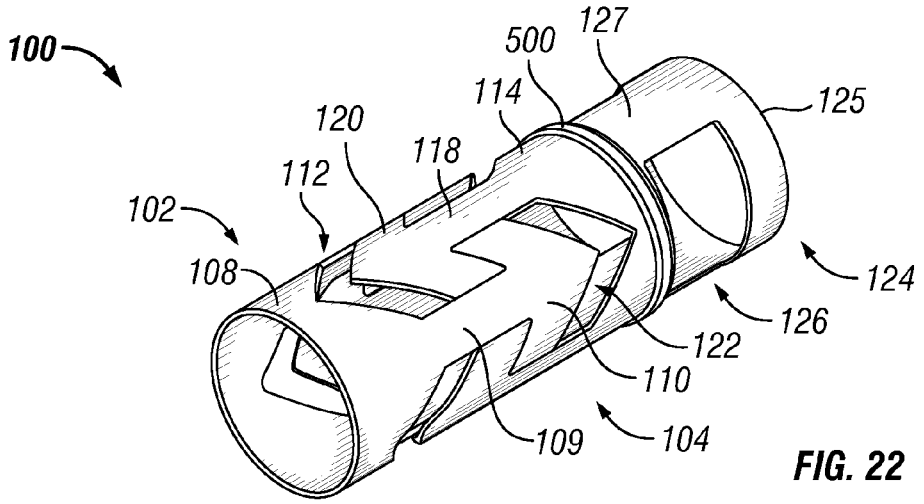
FIG. 22 is a perspective view of an extendable collar having a deflector, according to an embodiment.
Figure 23:
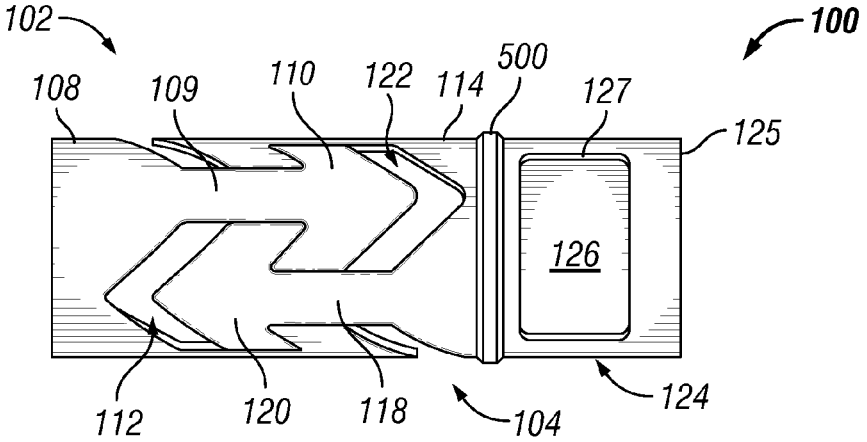
FIG. 23 is a side view of the extendable collar having the deflector, according to an embodiment.

FIGS. 22 and 23 illustrate the stop collar 100 according to another embodiment. As shown, in this embodiment, the stop collar 100 may include a deflector 500. The deflector 500 may be formed from a metal (e.g., steel, iron, etc.) ring secured to the outer diameter of the stop collar 100. For example, the deflector 500 may be welded, fastened, or otherwise attached to the annular base 114 of the second portion 104, as shown. In other embodiments, the deflector 500 may be attached to the annular base 108 or to the anchor base 125. In some embodiments, two or more deflectors 500, positioned at two or more of the bases 108, 114, and/or 125 may be provided. Further, instead of or in addition to such a metal ring, the deflector 500 may be formed at least partially from a thermal spray metal, as discussed above for the anchoring material 302. The deflector 500 may define any suitable shape or profile, whether rounded, squared, or otherwise formed.

Moreover, the deflector 500 may not extend continuously around the stop collar 100. For example, the deflector 500 may be segmented and, e.g., circumferentially aligned with the heads 110 and/or 120. Further, the deflector 500 may be circumferentially aligned with one or more of the heads 110, 120 and/or extensions 109, 118.

In operation, the deflector 500 may provide a positive outer diameter, which may protect the heads 110 and/or 120 from being damaged while the stop collar 100 is run into the wellbore. For example, an obstruction, debris, etc., may lodge in the chamber 112, 122 and engage the head 110, 120. The obstruction, debris, etc., may then bear against the wellbore or another structure, while the stop collar 100 is moved with respect thereto, such that the obstruction, debris, etc., bends the head 110, 120 and/or the extension 109, 118 outwards. The deflector 500 may prevent such occurrence, serving to push aside any such debris, obstructions, etc. that might otherwise potentially arm the stop collar 100.

Figure 24:
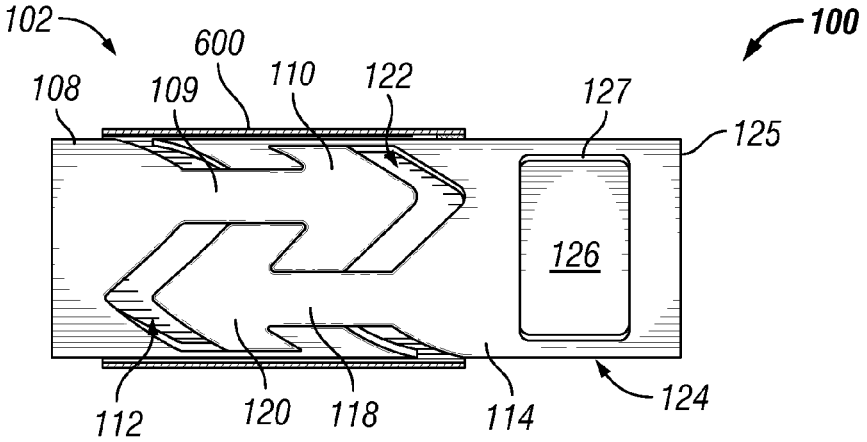
FIG. 24 is a side view of an extendable collar having a deflector formed as a sleeve, according to an embodiment.

Similarly, FIG. 24 is a side view of the stop collar 100 including another deflector 600, according to an embodiment. In this case, the deflector 600 is generally formed as a cover or sleeve that extends across at least a portion of the chambers 122 and/or the chambers 112. The deflector 600 may thus protect the heads 110, 120 from the damage discussed above. Further, the deflector 600 may be fixed to either the first portion 102 or, as shown, the second portion 104, so as to avoid impeding the slidable interconnection between the first and second portions 102, 104. Additionally, the deflector 600 may include seals, guards, etc., so as to prevent debris from moving between the deflector 600 and either of the bases 108 or 114, e.g., the base 108, 114 to which the deflector 600 is not attached.

Figure 25:
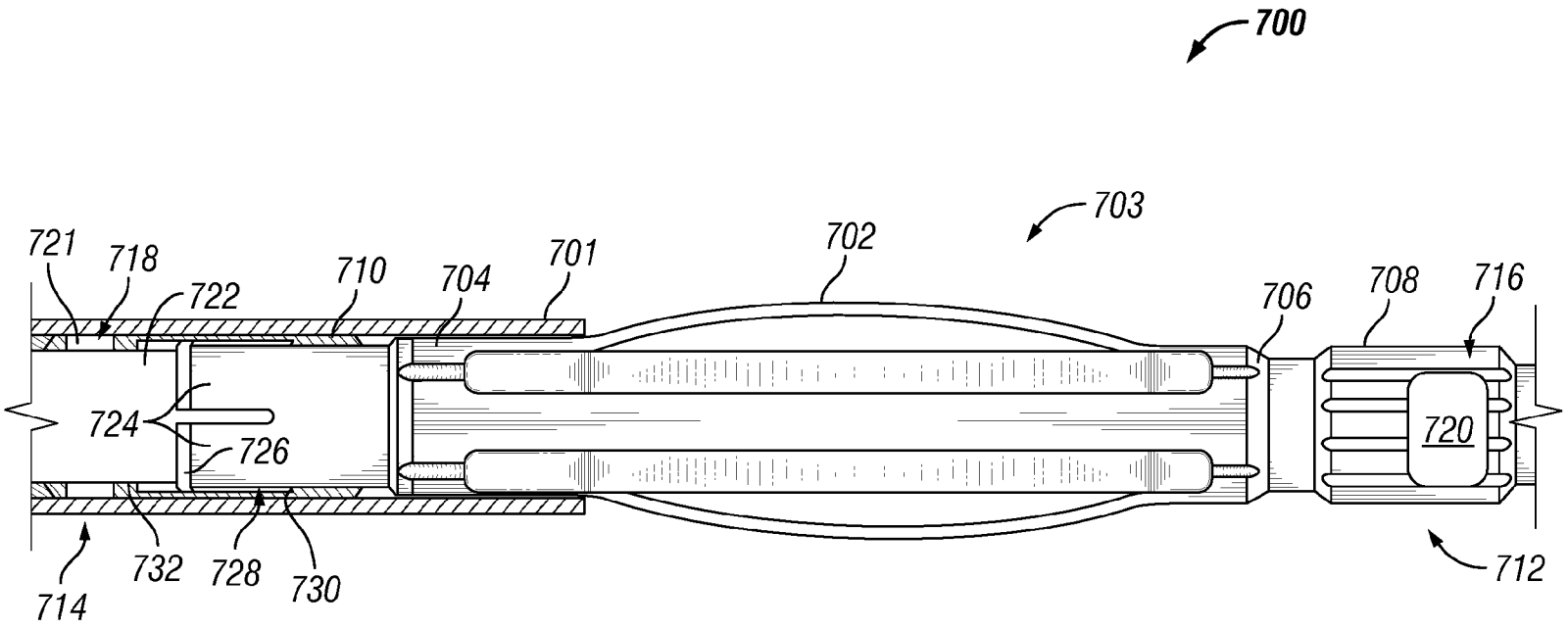
FIG. 25 is a side, partial cross-section view of a centralizer assembly, according to an embodiment.

FIG. 25 illustrates a side, partial cross-sectional view of a centralizer assembly 700, according to an embodiment. The illustrated centralizer assembly 700 is depicted being received through a wellbore restriction 701. As with the centralizer assemblies 200, the centralizer assembly 700 may include a centralizer 703 having ribs 702 that flex radially outward and extend axially between two end collars 704, 706, and which are configured to radially compress, so as to pass through the restriction 701. The centralizer 703 may be formed from a single pipe, as described above, or may be formed by cutting and rolling a flat plate, e.g., as described in U.S. patent application having Ser. No. 13/957,016, which is incorporated by reference above.

The end collars 704, 706 may be coupled with stop collars 708, 710 respectively and may be configured to slide across a range of axial positions to accommodate the inward and outward movement of the ribs 702. The stop collars 708, 710 may each define an anchor 712, 714. The anchors 712, 714 may be generally similar to the anchor 124 described above, and may each include one or more anchor windows 716, 718 extending radially therethrough. Anchoring material 720, 721 may be disposed in the anchor windows 716, 718 and fixed to a tubular 722 received through the assembly 700. The anchoring material 720, 721 may be a thermal spray material, such as metal, received radially inwards through the anchor windows 716, 718 and attached to the tubular 722 so as to provide a ridge against which the anchors 712, 714 may bear. An example of such an anchoring material is provided in U.S. Pat. No. 7,487,840, which is incorporated by reference above.

For illustrative purposes, the structure of the end collar 704 and the stop collar 710 is described herein. It will be appreciated that the end collar 706 and the stop collar 708 may be formed similar thereto, respectively. However, in other embodiments, they may be different.

In an embodiment, the end collar 704 and the stop collar 710 may cooperate to form a bearing plate. For example, the end collar 704 may include a plurality of fingers 724, which may extend axially therefrom. The fingers 724 may include or otherwise terminate with one or more protrusions 726, which extend radially outwards. The stop collar 710 may provide a complementary groove 728 on a radial inside thereof, which may be sized to receive the protrusions 726. The groove 728 may define an inboard shoulder 730 and an outboard shoulder 732, which may be sized to bear against the protrusions 726 and prevent the protrusions 726 from translating axially past. Further, the anchor window 718 may be defined through one of the shoulders 730, 732, e.g., the outboard shoulder 732 as shown.

Accordingly, depending on the relative size of the protrusions 726 and the groove 728, the protrusions 726 may be able to slide axially within the groove 728 between the shoulders 730, 732. This may, in turn, allow an axial range of motion for the end collar 704 with respect to the stop collar 710. In addition, the protrusions 726 may be rotatable around the tubular 722 in the groove 728, as the groove 728 may extend entirely around the tubular 722. It will be appreciated that the stop collar 710 (and/or 708) may be a single piece, as shown, or include multiple, e.g., axially-slidable pieces, such that the stop collar 710 (and/or 708) may be axially expandable.

Although described in the context of the centralizer assembly 700, it will be appreciated that the stop collars 708, 710 may be provided independently of the centralizer 703 for use in any suitable downhole or other types of applications. Accordingly, the stop collars 708, 710 should not be interpreted as requiring a centralizer 703, unless otherwise expressly stated herein.

Figure 26:
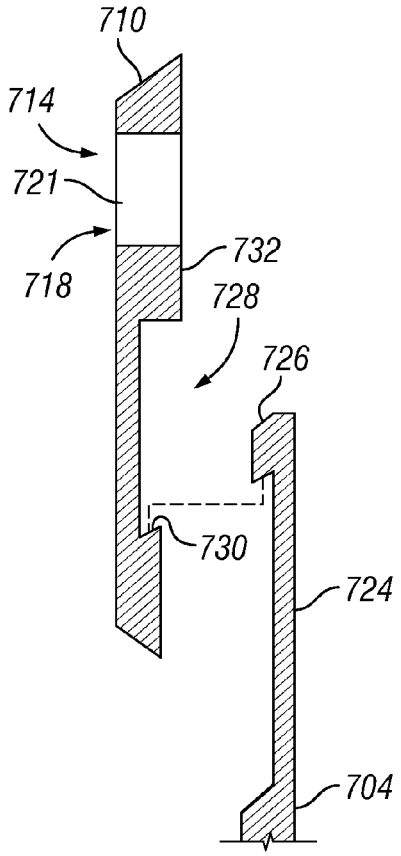
FIGS. 26 and 27 are side, cross-sectional views of a bearing plate cooperatively formed between an end collar and a stop collar, according to an embodiment.
Figure 27:
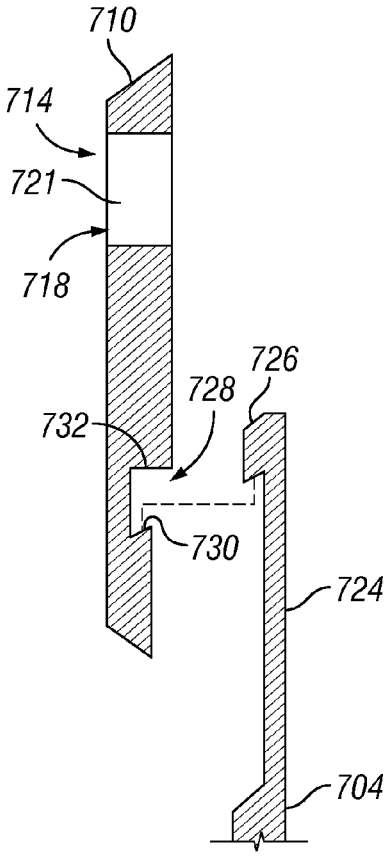

FIGS. 26 and 27 illustrate two cross-sectional views of the bearing plate formed between the protrusions 726 and groove 728. As shown, the protrusion 726 may fit into the groove 728, between the shoulders 730, 732. As shown in FIG. 26, the groove 728 may be axially larger than the protrusion 726, such that the protrusion 726 is able to slide relative to the stop collar 710. Moreover, the inboard shoulder 730 may be undercut, so as to prevent the protrusion 726 from being pulled past the inboard shoulder 730. Additionally, as shown, the finger 724 may be thinner (e.g., radially) than a remainder of the extension 704, such that the finger 724 is receivable past the shoulder 730 and slidable with respect thereto.

FIG. 27 shows a similar embodiment of the finger 724 and the stop collar 710; however, in this case, the groove 728 is substantially the same axial length as the protrusion 726, although it may be slightly larger to avoid friction forces. As such, the protrusion 726 may fit in the 728 and be prevented from axial translation with respect thereto, while allowing relative rotation therebetween.

Although described as the stop collar 710 including the groove 728 and the end collar 704 including the fingers 724 and protrusions 726, it will be appreciated that this configuration may be reversed. Accordingly, the fingers 724 and the protrusions 726 may form part of the stop collar 710, and the shoulders 730, 732 and the groove 728 therebetween may be provided by the end collar 704.

The terms "comprising," "including," and "having," as used in the claims and specification herein, shall be considered as indicating an open group that may include other elements not specified. The terms "a," "an," and the singular forms of words shall be taken to include the plural form of the same words, such that the terms mean that one or more of something is provided. The term "one" or "single" may be used to indicate that one and only one of something is intended. Similarly, other specific integer values, such as "two," may be used when a specific number of things is intended. The terms "preferably," "preferred," "prefer," "optionally," "may," and similar terms are used to indicate that an item, condition or step being referred to is an optional (not required) feature of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A centralizer assembly, comprising:

a centralizer configured to centralize a tubular in a wellbore, the centralizer comprising a first end collar, a second end collar, and a plurality of ribs extending between the first and second end collars; and a first stop collar disposed adjacent the first end collar and comprising an anchor, wherein the anchor defines a generally rectangular anchor window extending therethrough, wherein the anchor is configured to bear on an anchoring material secured to the tubular and received through the anchor window, and wherein the anchor material comprises a thermal spray applied to the tubular, wherein the first end collar is prevented from rotation with respect to the first stop collar.

2. The centralizer assembly of claim 1, wherein the first stop collar comprises a first portion engaging or integral with the first end collar, and a second portion coupled with the first portion such that the first and second portions are slidable one relative to the other along a longitudinal axis of the first stop collar.

3. The centralizer assembly of claim 2, wherein the centralizer is prevented from translating axially with respect to the first portion of the first stop collar.

4. The centralizer assembly of claim 3, wherein the first end collar is axially displaceable across a defined range of axial motion with respect to the second portion of the first stop collar.

5. The centralizer assembly of claim 4, wherein the first portion sliding relative to the second portion provides at least a portion of an axial range of movement for the first end collar relative to the second end collar.

6. The centralizer assembly of claim 2, wherein the anchor is coupled with the second portion of the first stop collar.

7. The centralizer assembly of claim 2, wherein:

the first portion comprises first extensions and first chambers; and the second portion comprises second extensions slidably received and at least partially retained in the first chambers, and second chambers slidably receiving and retaining at least a portion of the first extensions.

8. The centralizer assembly of claim 7, further comprising a deflector positioned at least partially around the first stop collar and extending radially outward therefrom, the deflector being configured to protect at least some of the first extensions, at least some of the second extensions, or at least some of both the first and second extensions.

9. The centralizer assembly of claim 1, further comprising a second stop collar, the centralizer being axially between the first and second stop collars, the second stop collar comprising an anchor defining a window therethrough that is configured to bear on an anchoring material secured to the tubular.

10. The centralizer assembly of claim 9, wherein the window of the first stop collar is circumferentially offset from the window of the second stop collar.

11. The centralizer assembly of claim 1, wherein the first stop collar is integrally-formed with at least a portion of the first end collar.

12. The centralizer assembly of claim 1, wherein the first end collar is integrally-formed with a first portion of the first stop collar, and is configured to slide across a predefined axial range of motion with respect to a second portion of the first stop collar.

13. The centralizer assembly of claim 1, further comprising a deflector comprising a thermal spray material extending around and outward from the first end collar, the first stop collar, or both.

* * * * *